US009695527B1

(12) United States Patent
Clement

(10) Patent No.: US 9,695,527 B1
(45) Date of Patent: Jul. 4, 2017

(54) UNIVERSAL HAND LOOM KIT FOR WEAVING AND CREATING EMBELLISHMENTS

(71) Applicant: Orchard Yarn and Thread Company, Inc., Carlstadt, NJ (US)

(72) Inventor: Carolyn G. Clement, Montpelier, VT (US)

(73) Assignee: Orchard Yarn and Thread Company, Inc., Carlstadt, NJ (US)

( * ) Notice: Subject to any disclaimer, the term of this patent is extended or adjusted under 35 U.S.C. 154(b) by 0 days.

(21) Appl. No.: 15/006,393

(22) Filed: Jan. 26, 2016

(51) Int. Cl.
*D03D 29/00* (2006.01)
*D03D 41/00* (2006.01)

(52) U.S. Cl.
CPC ..... *D03D 29/00* (2013.01)

(58) Field of Classification Search
CPC ... D03D 9/00; D04B 3/00; D04B 5/00; D04D 11/00; D04D 7/04; A44C 27/00; B65H 69/04
See application file for complete search history.

(56) References Cited

U.S. PATENT DOCUMENTS 1,361,055 A 12/1920 Henry
1,446,316 A 2/1923 Niemiec et al.
1,794,312 A 2/1931 Michelson
2,011,916 A 8/1935 Simonds
2,118,142 A 5/1938 Belash
2,159,265 A * 5/1939 Gash ..... D03D 29/00 139/34
2,186,692 A 1/1940 Boyer et al.
2,190,813 A * 2/1940 Walker ..... D03D 29/00 139/34
2,229,188 A 1/1941 Porter
2,481,955 A 9/1949 Simons
2,780,854 A * 2/1957 Dritz ..... D03D 29/00 139/34
3,054,429 A 9/1962 Gardner
3,209,336 A * 9/1965 Smith ..... G11C 5/04 139/34
3,800,372 A * 4/1974 Daoust ..... D03D 29/00 28/152
3,812,887 A * 5/1974 Stars ..... D03J 5/00 139/29
4,023,245 A * 5/1977 Zaltzman ..... D03D 29/00 28/152
4,046,172 A 9/1977 Russell
(Continued)

*Primary Examiner* — Bobby Muromoto, Jr.
(74) *Attorney, Agent, or Firm* — Myron Greenspan Lackenbach Siegel LLP

(57) ABSTRACT

A universal hand loom kit includes a peg board with an array of holes. Long pegs are provided each configured at one end to be releasably inserted into one of the holes in the peg board and having an exposed length when mounted on the peg board within the range of 2"-4" or approximately 50 mm-102 mm. Short pegs are provided each configured at the one end to be releasably inserted into one of the holes in the peg board and having an exposed length when mounted on the peg board less than the length of the long pegs. A shuttle stick, a long needle weaver, a short tapestry needle and a comb are included. The kit can be used to create two dimensional woven tapestry-type products and three dimensional embellishments such as flowers, pompoms, tassels and fringes.

21 Claims, 31 Drawing Sheets

(56) References Cited

U.S. PATENT DOCUMENTS

| | | | | | |
|---|---|---|---|---|---|
| 4,081,885 | A | | 4/1978 | Shank | |
| 4,248,063 | A | * | 2/1981 | Wang | D04B 3/00 66/4 |
| 4,301,839 | A | * | 11/1981 | Yamaguchi | D03D 29/00 139/29 |
| 4,416,040 | A | * | 11/1983 | Towsley | D03D 29/00 28/152 |
| 4,741,366 | A | * | 5/1988 | Yamotogi | D03D 29/00 139/34 |
| 7,506,524 | B2 | * | 3/2009 | Gustin | D04B 5/00 66/1 A |
| 8,316,894 | B2 | * | 11/2012 | Schaub | D03D 29/00 139/1 R |
| 8,684,420 | B2 | * | 4/2014 | Ng | A44C 5/0069 289/17 |
| 2010/0218840 | A1 | * | 9/2010 | Crorey | D04G 5/00 139/29 |
| 2015/0096643 | A1 | * | 4/2015 | Lawrence | D03D 29/00 139/33 |

* cited by examiner

UNIVERSAL HAND LOOM KIT FOR WEAVING AND CREATING EMBELLISHMENTS

BACKGROUND OF THE INVENTION

1. Field of the Invention

The present invention generally relates to hand weaving devices and, more specifically, to a universal hand loom kit.

2. Description of Prior Art

Tapestry weaving is an ancient craft. While weaving looms of different complexities have been devised the very simplest are the hand-weaving looms in the form of a piece cardboard and string that children use when first exposed to weaving.

Most hand-held weaving looms utilize pins or pegs all of which are the same height because most woven textiles are essentially flat or two dimensional.

In U.S. Pat. No. 4,081,885 a method of making a textile product is disclosed on a rectangular loom. The strands of yarn are applied to form a grid like backing web to form intersections of the strands and overlying yarns are secured together by being tied. An implement in the form of a stiff member is then passed between the backing web and the adjacent runs of yarn and then yarns that are transverse to the member are cut midway between the intersections. Cut yarns then form a rosette. The reference discloses pegs all of which have the same height or length to create rosettes, fringes or tassels. However, the method disclosed utilizes a generally rectangular frame having an open area within the boundaries of the frame so that pegs may only be secured to or rails forming the loom itself. The loom, therefore, is limited as to the forms of woven items that can be made on it. Other similar special purpose looms are disclosed in the following patents:

U.S. Pat. No. 1,361,055 issued Dec. 7, 1920
U.S. Pat. No. 1,446,316 issued Feb. 20, 1923
U.S. Pat. No. 1,794,312 issued Feb. 24, 1931
U.S. Pat. No. 2,011,916 issued Aug. 20, 1935
U.S. Pat. No. 2,186,692 issued Jan. 9, 1940
U.S. Pat. No. 2,229,188 issued Jan. 21, 1941
U.S. Pat. No. 2,481,955 issued Sep. 13, 1949
U.S. Pat. No. 2,780,854 issued Feb. 12, 1957
U.S. Pat. No. 3,209,336 issued Sep. 28, 1965
U.S. Pat. No. 4,046,172 issued Sep. 6, 1977
U.S. Pat. No. 4,081,885 issued Apr. 4, 1978

In U.S. Pat. No. 4,741,366 a hand-weaving device is disclosed that utilizes a peg board with an array of holes for weaving pins. The use of a peg board with an array of holes allows the pegs to be arranged anywhere on the peg board to provide more flexibility in the configuration or shape of a woven product. The weaving device is intended to simplify weaving and make it more efficient. However, the patent only teaches weaving of more conventional, two dimensional items. Although the patent teaches several variously shaped and dimensioned pegs or pins they are simply disclosed as alternative peg designs. Some of the pegs have a rod portion projecting above the peg board when mounted of 7 mm plus a gripping or holding portion of approximately 2.5-3.5 mm. Another peg is disclosed that has a rod portion above the peg board of 10 mm and a 5 mm enlarged gripping portion. Each of the pegs has a fringe of approximately 4.5-5 mm to provide pins with a total exposure above the peg board when mounted between 14.5 mm and 19.5 mm. These are too short for most embellishments such as pompoms, fringes and tassels.

To address the short comings of conventional hand looms and facilitate the creation of a specialty works, such as pompoms, specialty devices have been devised that do not use hand looms. For example, a pompom maker is marketed by Clover Needle Craft, Inc., of California under Model Nos. 3124 and 3126 (www.clover-usa.com) that does not use a peg board, pegs or other conventional weaving components.

Similarly, a hand loom is disclosed in U.S. Pat. No. 3,054,429 in which the frame is formed by four rods secured to define a rectangular frame, the yarn being wrapped around the rods instead of pegs or pins that project from a rectangular frame. In some instances, looms of this type are adjustable to adjust the size or shape of the rectangular opening. U.S. Pat. No. 2,118,142 discloses a hand weaving frame that can be enlarged or reduced in size to form a square frame. An adjustable loom for hand weaving is also disclosed in U.S. Pat. No. 3,800,372 in which orthogonal rails or frame members are adjustable to increase or decrease the size of the product to be woven. Another portable hand loom is disclosed in U.S. Pat. No. 2,190,813 that also includes angular cross members for enabling the shape of the frame to be modified to make oval or round rugs. In all of these patents, however, pins or pegs of the same size are arranged on the frame members leaving an open space within the boundaries of the frame segments or rails. All of these portable looms, therefore, are designed to provide limited functions and capability for only making conventional tapestry-type woven items.

A weaving device is disclosed in U.S. Pat. No. 2,159,265 that, as with the previously mentioned looms, is formed by a generally rectangular frame. As an aid to the winding or weaving operation the patent suggest that every other pin in one row is visibly distinguished from intervening pins so that the end pins of each row have the same distinguishing feature as the adjacent end pin of an adjacent row. For this purpose, the patent suggests that every other pin be made shorter than the intervening pins. However, these differently sized pins are mounted on the lateral legs or rails of the frame and are not used to create or form different woven items but, simply, as an aid to the winding operation.

SUMMARY OF THE INVENTION

It is an object of the invention to provide a universal hand loom kit that overcomes the disadvantages inherent in prior art hand looms and hand loom kits.

It is another object of the invention to provide a universal hand loom kit that is simple in construction and economical to manufacture.

It is still another object of the invention to provide a universal hand loom kit that is easy and convenient to be used.

It is a further object of the invention to provide a universal hand loom kit that can be used to create two dimensional as well as three dimensional objects or shapes made out of yarn including woven pictures.

It is still a further object of the invention to provide a universal hand loom kit as in the previous objects that can be used with standard or short pegs to create generally two and three dimensional objects out of yarn and long or embellishment pegs for creating three dimensional objects or embellishments out of yarn.

It is yet another object of the invention to provide a hand loom kit of the type under consideration that is formed by a solid or rigid peg board but that can be extended or increased in size and configured to provide objects of different sizes and shapes.

In order to achieve the above objects, as well as others that will become apparent hereinafter, a universal hand loom kit in accordance with the invention comprises a square or any rectangular peg board provided with a rectangular array of holes forming a plurality of spaced rows and a plurality of orthogonal spaced columns. A plurality of long or embellishment pegs are provided each configured at one end to be releasably inserted into one of the holes in the peg board, each long peg having an exposed length when mounted on the peg board within the range of 2"-4" or approximately 50 mm 102 mm. A plurality of short pegs are provided each configured at the one end to be releasably inserted into one of the holes in the peg board, each short peg having an exposed length when mounted on the peg board less than the length of the long pegs. The kit is also provided with a shuttle, a needle weaver, a short tapestry needle and a weft comb. The kit is universal in that it can be used to quickly convert from a device for creating two dimensional woven tapestry-type shapes/products of different sizes, shapes, colors and configurations to a device that can be used to make three dimensional shapes, objects or embellishments such as pompoms, tassels, fringes, etc. The kit can be expanded to create larger shapes or embellishments by joining two or more peg boards together by using suitable joiners or connecting members to secure two or more peg boards to each other.

BRIEF DESCRIPTION OF THE DRAWINGS

Those skilled in the art will appreciate the improvements and advantages that derive from the present invention upon reading the following detailed description, claims, and drawings, in which:

DETAILED DESCRIPTION

Figure 1:
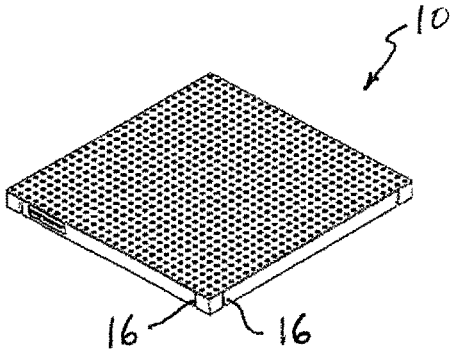
FIG. 1 is a perspective view of a peg board in accordance with a first embodiment of the invention.

Referring now to the Figures, in which the identical or similar parts are designated by the same reference numerals throughout a presently preferred embodiment of a universal hand loom kit in accordance with one embodiment of the invention includes the following components:

| Item | Quantity |
|---|---|
| Peg Board/Loom Base | 1 |
| Standard or short peg | 150 |
| Embellishment or long pegs | 15 |
| Shuttle | 1 |
| Needle weaver (8 cm) | 1 |
| Short Tapestry Needle | 1 |
| Comb | 1 |
| Yarn (optional) | |
| Pattern Sheet (optional) | |

Referring to FIGS. 1-8, a peg board in accordance with the invention is generally designated by the reference numeral 10.

Figure 6:
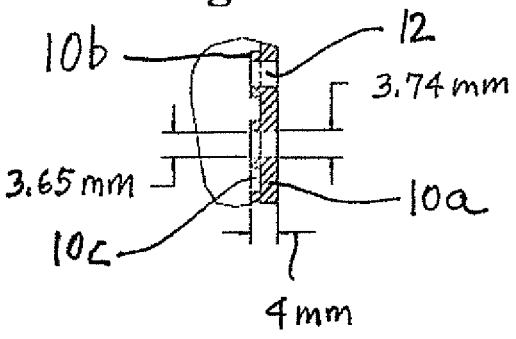
FIG. 6 is an enlarged detail A taken from FIG. 3.

The peg board 10 has a generally rigid upper panel 10*a* formed with a rectangular array of apertures or holes 12 that form a plurality of spaced horizontal rows (as viewed in FIG. 2) and a plurality of orthogonal spaced vertical columns. Referring particularly to FIG. 6, the peg board has an enlarged thickness or boss 12*b* surrounding each hole or aperture 12 each hole resulting in recesses 10*c* between adjacent bosses. This reduces the amount of material required to produce the peg board while providing sufficient depth or thickness for the holes 12 to secure and provide stability of the pegs mounted thereon. A skirt 10*d* extends about the outer peripheral of the peg board.

Cylindrical posts 14 are preferably provided at each corner for receiving, at the lower open ends, rubber feet 15 to enable placement of the board on a surface without scratching it and for providing better stability. The cylindrical posts 14 may be provided with an internal bevel 14*a* to facilitate insertion of the rubber feet 15 into the cylindrical posts.

Figure 7:
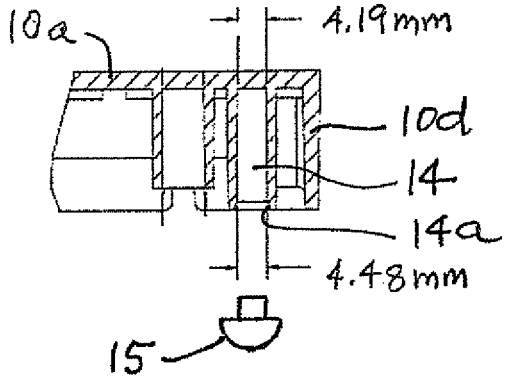
FIG. 7 is an enlarged detail B taken from FIG. 5.
Figure 8:
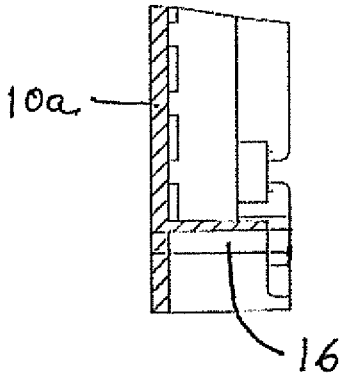
FIG. 8 is an enlarged detail C taken from FIG. 4.

Receptacles 16 may be formed at each corner, as best shown in FIGS. 1, 7 and 8 for facilitating interconnection of like peg boards, as to be further described.

Figure 2:
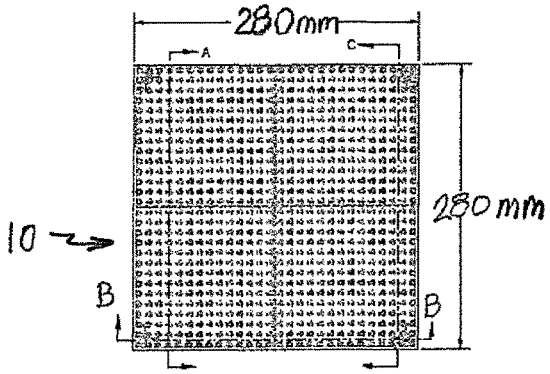
FIG. 2 is a bottom plan view of the peg board shown in FIG. 1.
Figure 3:
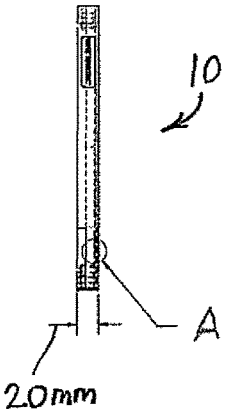
FIG. 3 is a cross sectional view of the peg board shown in FIG. 2, taken along line A-A.
Figure 4:
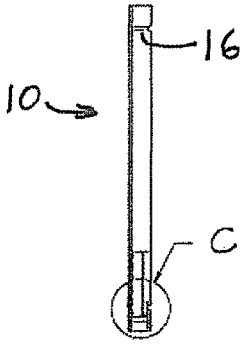
FIG. 4 is a cross sectional view of the peg board shown in FIG. 2, taken along line C-C.
Figure 5:
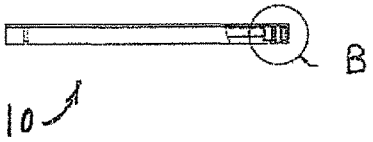
FIG. 5 is a cross sectional view of the peg board shown in FIG. 2, taken along line B-B.

It will be evident that the peg board dimensions are not critical and while the peg board is shown to be a 280 mm square, the peg board may be made smaller or larger or may assume any rectangular shape in which the height and width dimensions, as viewed in FIG. 2, are different. Similarly, the height or thickness of the peg board is not critical. While the peg board is shown having thickness of 20 mm any other suitable and practical height of the board may be used as long as the axial lengths of the holes 12 can be made sufficiently long to securely receive pegs and prevent them from wobbling or pivoting during use. In the embodiment illustrated, the axial thickness of the board upper panel is 4 mm although, as indicated, this dimension is not critical but should correspond to the dimensional configurations of the pegs as will be described hereinafter.

Figure 9:
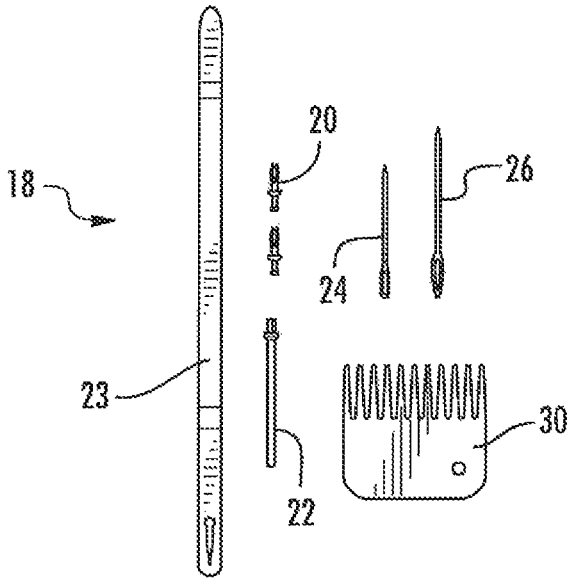
FIG. 9 is a top plan view of representative components that can be used with the peg board shown in FIG. 1.
Figure 10:
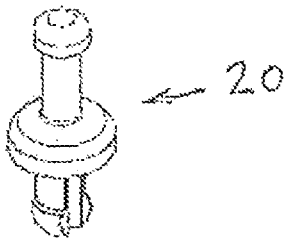
FIG. 10 is a perspective view of a standard or short peg forming part of the universal hand loom.
Figure 11:
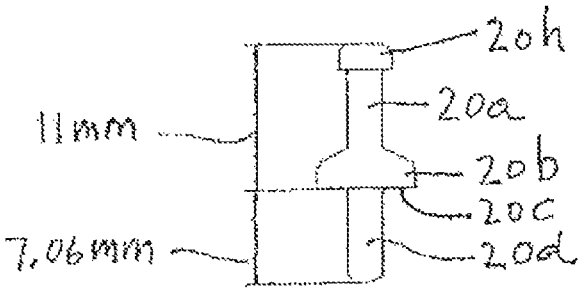
FIG. 11 is a front elevational view of the peg shown in FIG. 10.

Referring to FIG. 9, components or elements that can be used with the peg board 10 include short pegs 20, embellishment or long pegs 22, tapestry needle 24, needle weaver 26, shuttle 28 and comb 30.

Figure 9A:
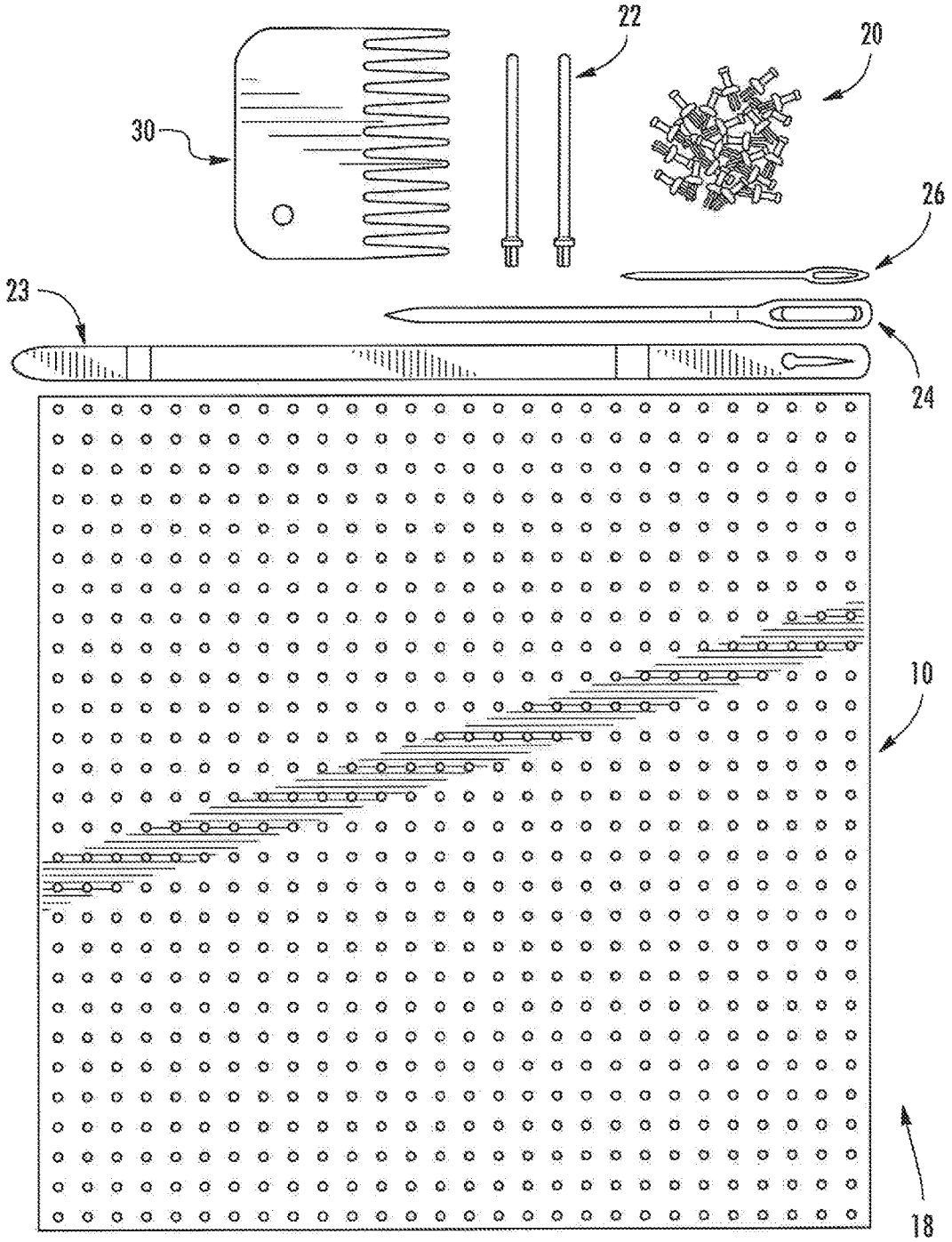
FIG. 9A is a top plan view of components that can form a universal hand loom kit in accordance with the invention.
Figure 12:
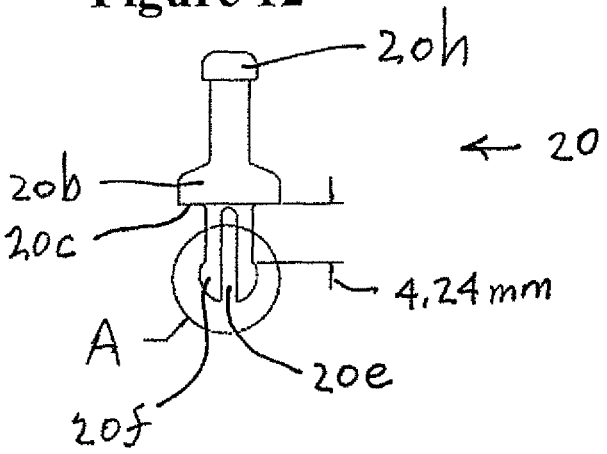
FIG. 12 is a side elevational view of the peg shown in FIGS. 10 and 11.
Figure 13:
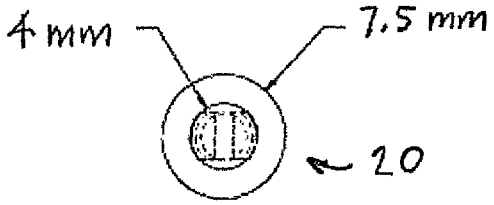
FIG. 13 is a top plan view of the peg shown in FIGS. 10-12.
Figure 14:
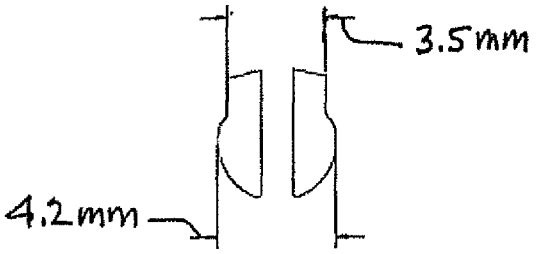
FIG. 14 is an enlarged detail A taken from FIG. 12.

The components shown in FIG. 9 together with a peg board 10 form a "starter" kit 18 shown in FIG. 9A. As will be more fully described, the standard pegs 20 and the embellishment or long pegs 22 are used for different purposes, for achieving different products or items and the number of each of the pegs is not critical. In a presently preferred embodiment, however, the starter kit includes 150 short pegs and 15 embellishment or long pegs 15. For a peg board 10 including 28 holes on each side at least 56 short pegs should be provided in the kit. If the peg board has a different non-square rectangular shape the number of short pegs should normally be twice the number of holes along the longer side of the board. Only one of each of the remaining components or elements shown need be included in the kit. The kit 18 may optionally include yarn and one or more pattern sheets (not shown).

Referring to FIGS. 10-14, a standard or short peg or pin 20 in accordance with the invention is shown that has a elongated shank 20*a* provided with an enlarged lower shoulder 20*b* defining a under surface 20*c*. Extending or projecting downwardly from the under surface 20*c* is a leg or foot 20*d* that is provided with an axial slot 20*e* to substantially split the leg or foot 20*d* and render it more resilient or flexible along a direction transverse to the slot 20*e*. Provided at the bottom of the leg or foot 20*d* is a bulbous enlargement or protuberance 20*f* dimensioned to be received within a hole 12 in press fit relationship. The dimensions and tolerances can be modified as long as this relationship is achieved. In the example shown, the diameters of the holes 12 is approximately 174 mm and the transverse dimension 20*g* (FIG. 14) of the enlarged end is 4.2 mm so that when the peg 20 is inserted into a hole 12 the split portions of the foot or leg are compressed inwardly to fit within the hole. The portion of the foot or leg between the enlarged end 20*f* and the undersurface 20*c* is 4.2 mm long while the axial length of the holes 12 is 4 mm so that once the peg is inserted into the board the enlarged end extends through the board and projects beyond or below the hole 12 while the rest of the foot or leg sits within the hole 12 with little or no clearance. An enlarged linger grip 20*h* is advantageously provided to facilitate the gripping of the peg for pulling and removing it from the board against the press fit relationship between the two.

Figure 15:
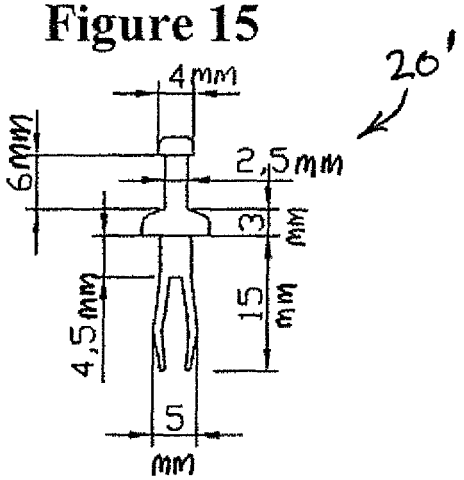
FIG. 15 is a side elevational view of an alternate embodiment of a standard or short peg in accordance with the invention.
Figure 16:
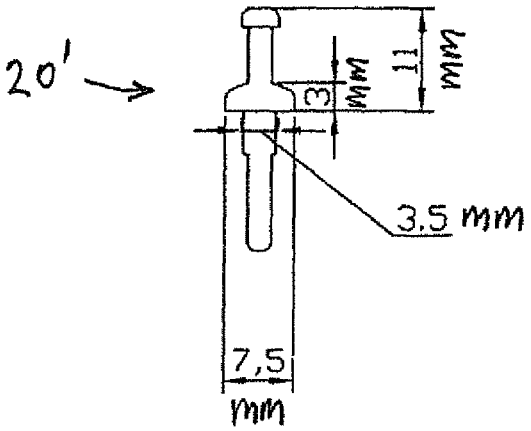
FIG. 16 is a front elevational view of the peg shown in FIG. 15.
Figure 17:
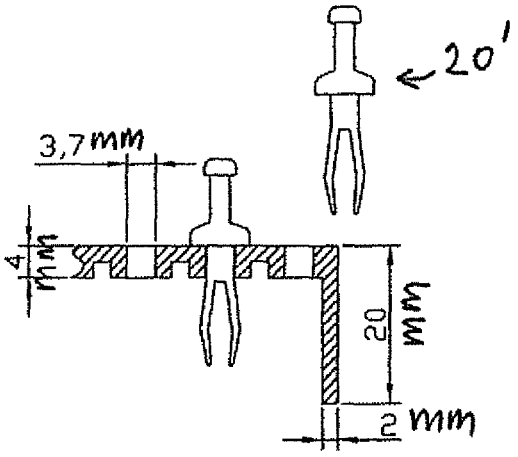
FIG. 17 is an enlarged cross section of a portion of a peg board, showing the retaining portion of the alternate embodiment of the standard or short peg secured within an aperture or hole of the peg board.
Figure 18:
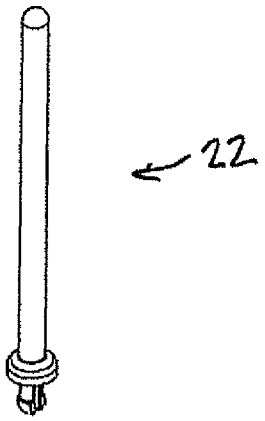
FIG. 18 is a perspective view of one embodiment of an embellishment or long peg in accordance with the invention.
Figure 19:
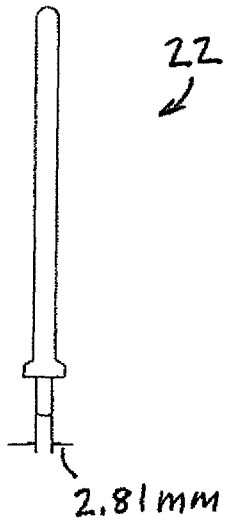
FIG. 19 is a front elevational view of the peg shown in FIG. 18.
Figure 20:
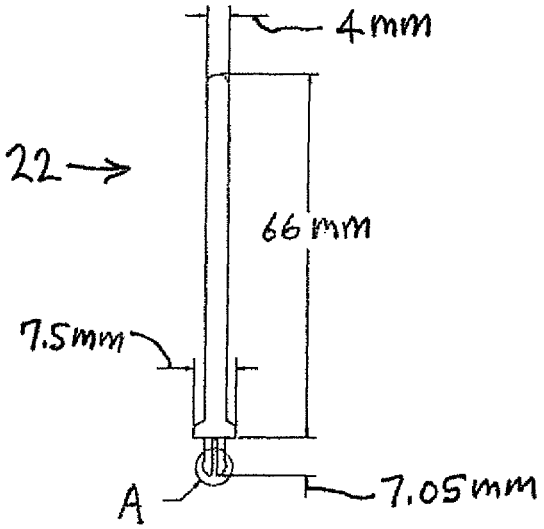
FIG. 20 is a side elevational view of the peg shown in FIGS. 18 and 19.
Figure 21:
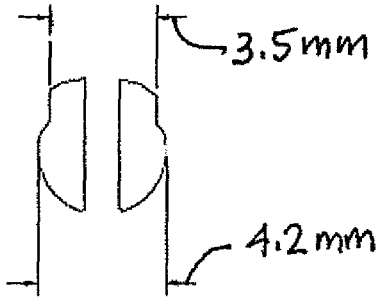
FIG. 21 is an enlarged detail A taken from FIG. 20.

An alternate embodiment 20' of the standard or short peg is shown in FIGS. 15-17 in which the foot or the leg of the peg projects laterally outwardly instead of providing the enlargement 20*f* of the previous embodiment. Otherwise, the peg 20' is the same and functions the same as the peg 20.

Figure 22:
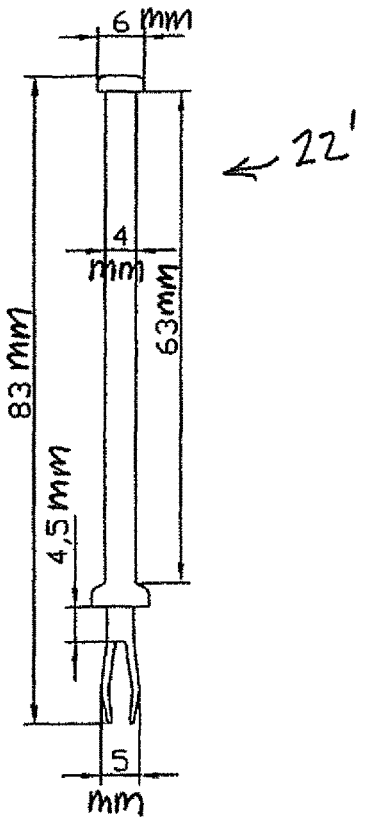
FIG. 22 is a side elevational view of an alternate embodiment of an embellishment or long peg in accordance with the invention.
Figure 23:
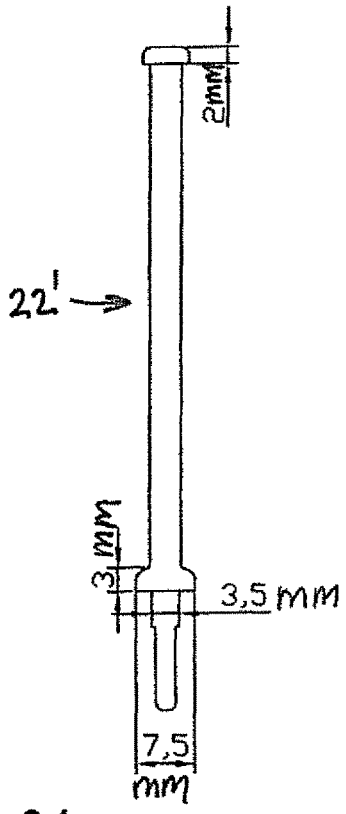
FIG. 23 is a front elevational view of the peg shown in FIG. 22.
Figure 24:
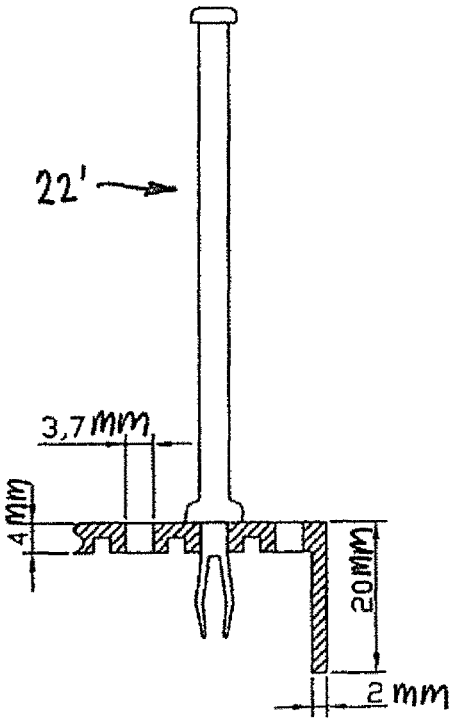
FIG. 24 is similar to FIG. 17 but showing the alternate embellishment or long peg mounted on the peg board.
Figure 25:
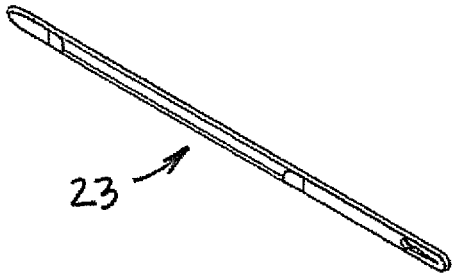
FIG. 25 is a perspective view of a shuttle weaver forming part of the kit in accordance with the invention.
Figure 26:
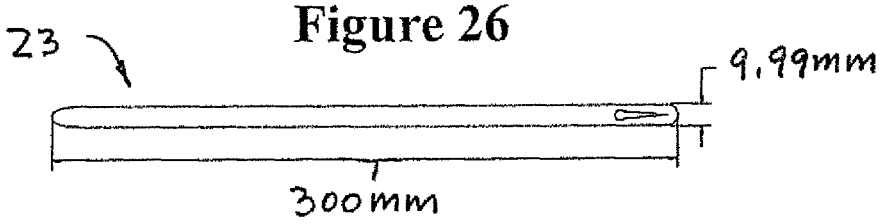
FIG. 26 is a front elevational view of the shuttle shown in FIG. 25.
Figure 27:
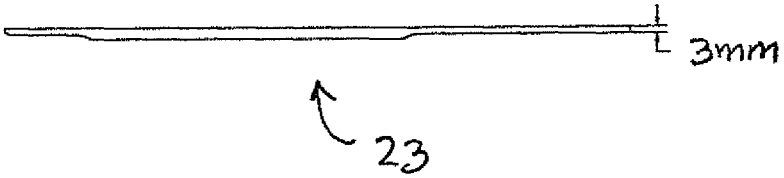
FIG. 27 is a side elevational view of the shuttle shown in FIGS. 25 and 26.
Figure 28:
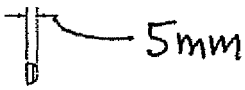
FIG. 28 is an end elevational view of the shuttle shown in FIG. 26.
Figure 29:
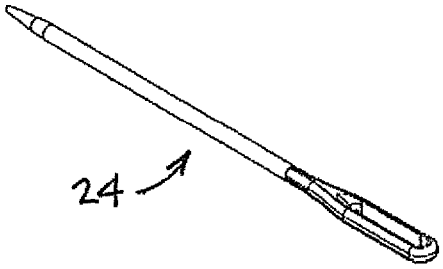
FIG. 29 is a perspective view of a short needle weaver forming part of the kit in accordance with the invention.
Figure 30:
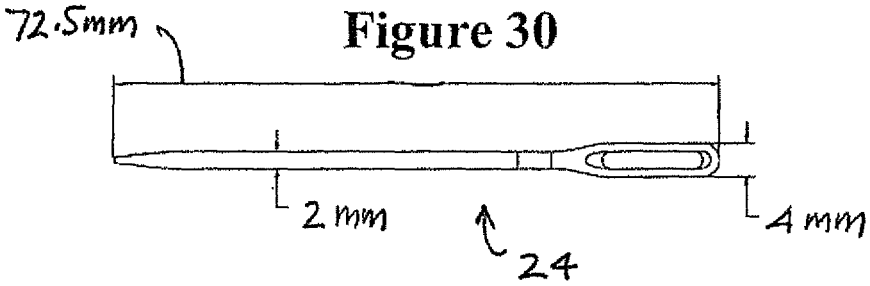
FIG. 30 is a front elevational view of the needle weaver shown in FIG. 29.
Figure 31:
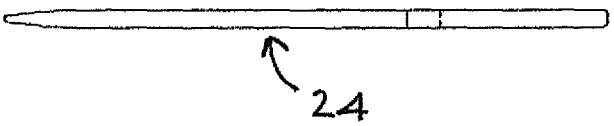
FIG. 31 is a side elevational view of the needle weaver shown in FIGS. 29 and 30.
Figure 32:
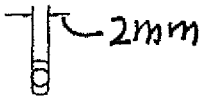
FIG. 32 is an end elevational view of the needle weaver shown in FIG. 30.
Figure 33:
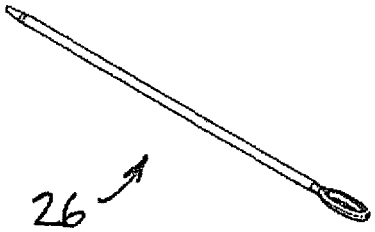
FIG. 33 is a perspective view of a needle weaver forming part of the kit in accordance with the invention.
Figure 34:
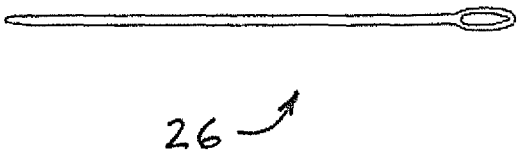
FIG. 34 is a front elevational view of the needle weaver shown in FIG. 33.
Figure 35:
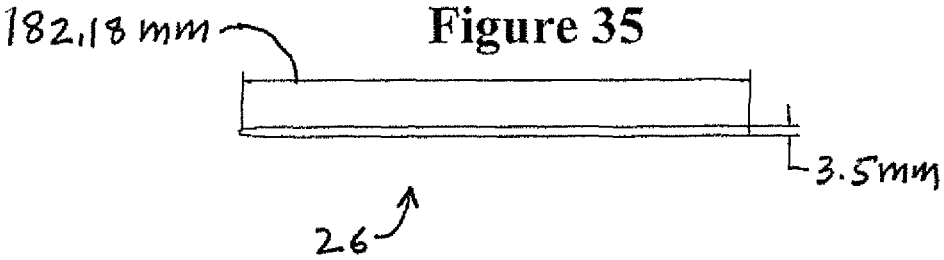
FIG. 35 is a side elevational view of the needle weaver shown in FIGS. 33 and 34.
Figure 36:
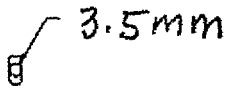
FIG. 36 is an end elevational view of the needle weaver shown in FIG. 34.

Referring to FIGS. 18-21, an embellishment or long peg 22 is shown. The foot or leg of peg 22 is similar to the one for the standard peg 20 shown in FIGS. 10-13. The peg 22 is distinguished from the standard peg by being significantly longer. While the standard peg extends approximately 11 mm above the top surface of the peg board, the embellishment or long peg 22 project or extend above the peg board approximately 66 mm. The diameter of the shank is 4 mm although, unlike the standard peg 20 does not have an enlarged grip at the upper free end. The axial length of the long peg 22 is not critical although it should be within the range of 2" and 4" (approximately 50 mm-102 mm). The standard pegs 22 will always have a length that is less than the length of the embellishment or long pegs in the kit. An alternate embodiment 22' for the long peg is shown in FIGS. 22-24 in which the foot or the leg of the long pin flares out similarly to the modified embodiment of the short peg shown in FIGS. 15-17. This modified peg 22' also has an upper gripping portion at the upper free end.

The other components or elements of the kit can be conventional weaving elements or components. Referring to FIGS. 25-28 a shuttle 23 is shown having a reduced thickness at one axial end and an eyelet for receiving a yarn at the other end. A tapestry needle 24 in accordance with the invention is shown in FIGS. 29-32. While any tapestry needle can be used the short tapestry needle 24, in the example, is 72.50 mm long while a long needle weaver 26 forming part of the kit shown in FIGS. 33-36 is 182.18 mm in length in the example shown. However, these dimensions are not critical.

Figure 37:
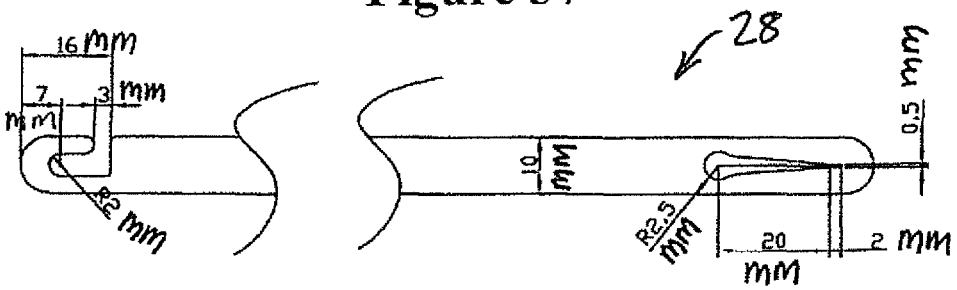
FIG. 37 is a fragmented side elevational view of a weaver hook that may optionally be included in the kit in accordance with the invention.
Figure 38:
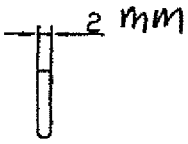
FIG. 38 is an end elevational view of the weaver hook shown in FIG. 37.

Referring to FIGS. 37 and 38 an optional shuttle hook 28 may be provided in addition to or in place of the yarn weaver 23 and the specific configuration or dimensions of the weaver hook are not critical.

Figure 39:
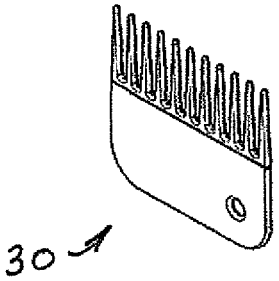
FIG. 39 is a perspective view of a comb forming part of the kit in accordance with the invention.
Figure 40:
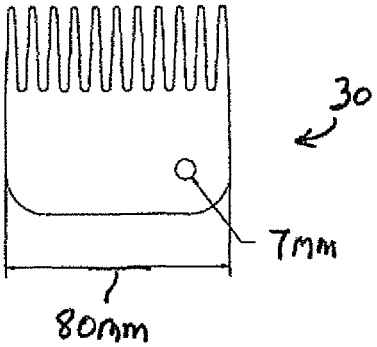
FIG. 40 is a front elevational view of the comb shown in FIG. 39.
Figure 41:
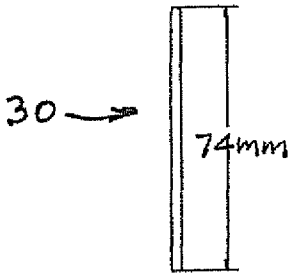
FIG. 41 is a side elevational view of the comb shown in FIG. 40.
Figure 42:
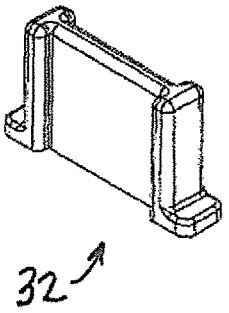
FIG. 42 is a perspective view of a board joiner in accordance with the invention for interconnecting peg boards of the type shown in FIGS. 1-8.
Figure 43:
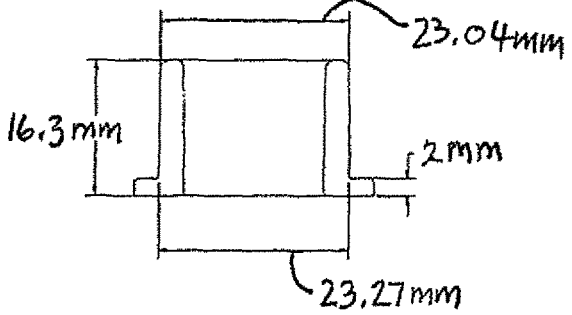
FIG. 43 is a front elevational view of the board joiner shown in FIG. 42.
Figure 44:
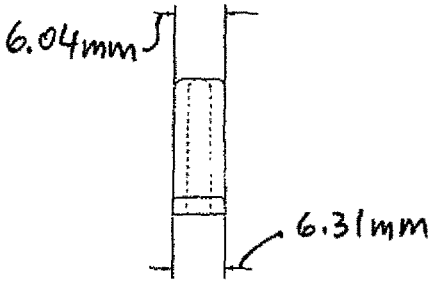
FIG. 44 is a side elevational view of the board joiner shown in FIGS. 42 and 43.
Figure 45:
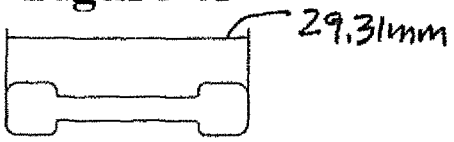
FIG. 45 is a top plan view of the board joiner shown in FIGS. 42-44.
Figure 45A:
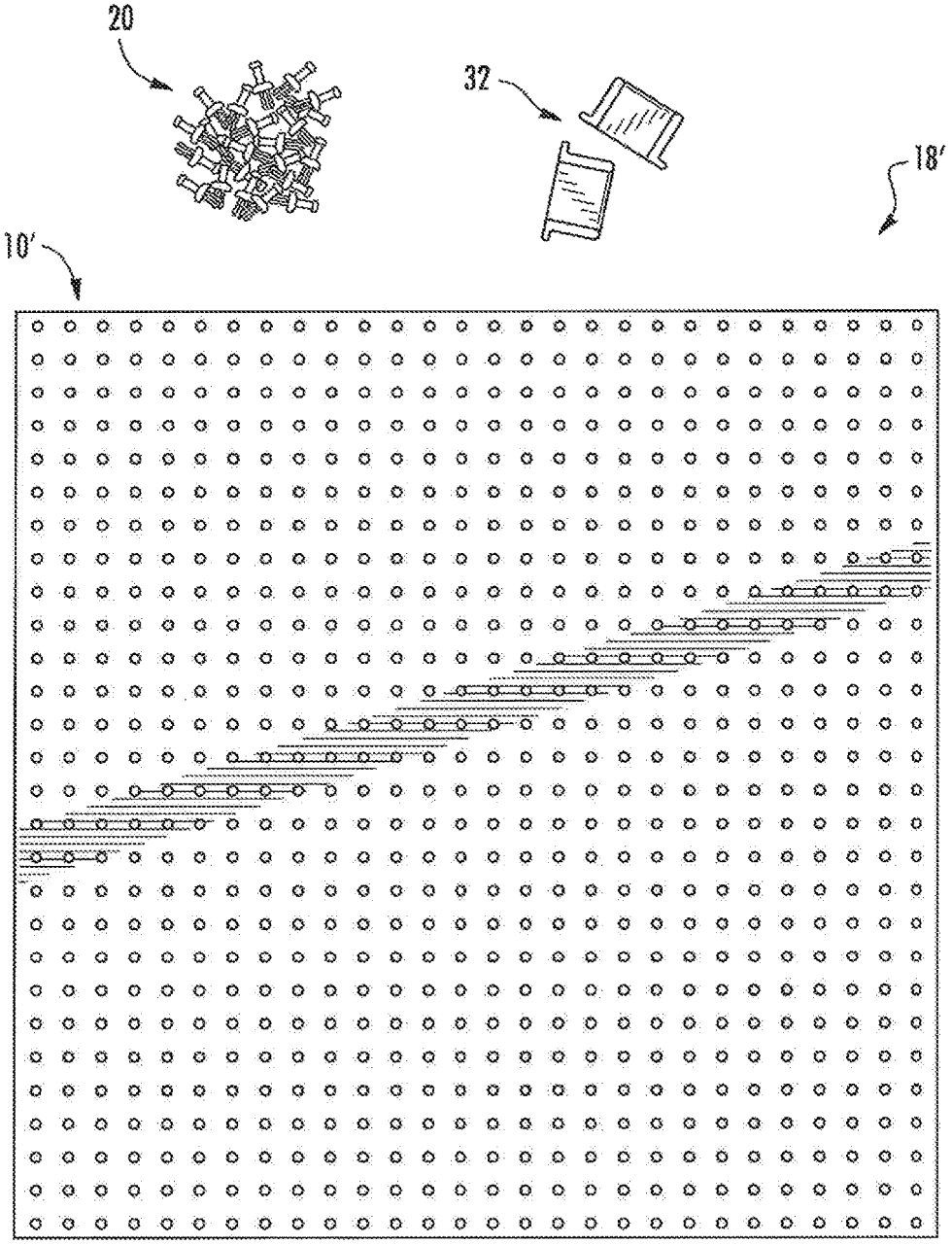
FIG. 45A is a perspective view of an extension kit for enlarging the size or area of the peg board shown in FIGS. 1-8 and 9A by using the joiners shown in FIGS. 42-45.
Figure 46:
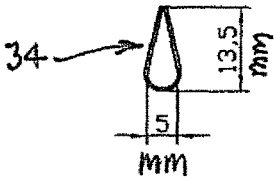
FIG. 46 is an alternate embodiment of a board joiner.

In FIGS. 39-41, an example of a comb 30 is shown that is included in the starter kit 18, although any other conventional weaving comb may be used.

Another feature of the invention is that the peg board 10, while generally of rigid construction can be combined or attached to each other like peg boards to create larger or variously shaped peg boards. Referring to FIGS. 42-45 a board joiner or connector 32 is shown that can be inserted or received within recesses 10*c* on the peg board 10 in press fit relationship for maintaining two adjacent co-planer peg boards in abutment against each other. The connector or board joiner shown in FIGS. 42-45 is but one example of a component that may be used. Such joiners or connectors 32 can be supplied with an "expansion" kit 18' that allows an additional peg board 10' to be joined to a starter kit board 10. In addition to the joiners the expansion kit includes additional pegs 20 to accommodate larger designs.

Figure 47:
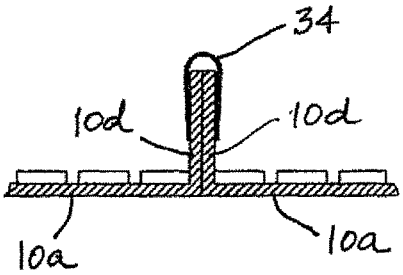
FIG. 47 is a fragmented view of two adjoining peg boards joined or secured to each other with a joiner shown in FIG. 46.
Figure 48:
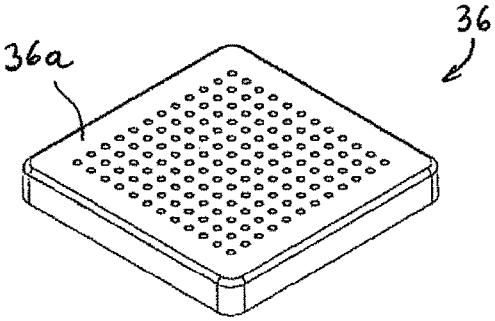
FIG. 48 is a perspective view of a modified weaver board in accordance with an alternate embodiment of the invention.
Figure 49:
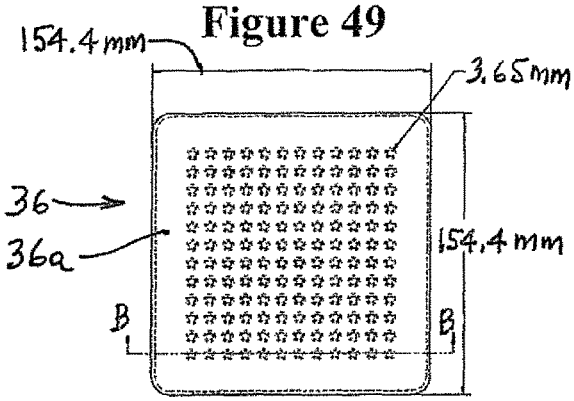
FIG. 49 is a top plan view of the weaver board shown in FIG. 48.
Figure 50:
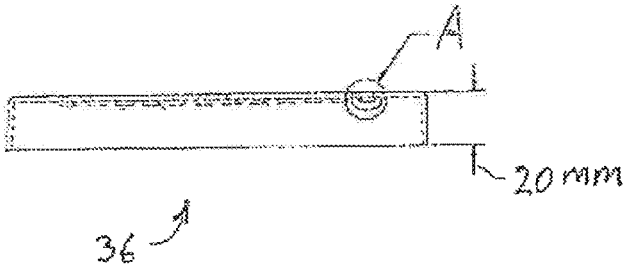
FIG. 50 is a side elevational view of the weaver board shown in FIGS. 48 and 49.
Figure 51:
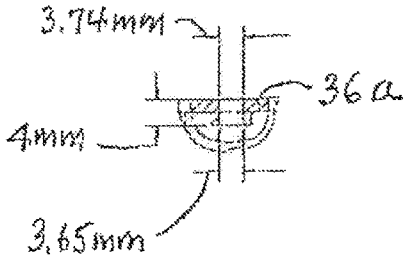
FIG. 51 is an enlarged detail A taken from FIG. 50.

It will be evident that other methods can be used for securing two co planer boards in abutment against each other and the invention contemplates the use of any suitable or conventional connectors for this purpose. Thus, for example, an alternate form of connector or board joiner 34 is shown that is the nature of a flat metallic u-shaped spring clip that may be expanded as shown in FIG. 47 to secure the downwardly extending ends of the skirts 10*d* of the boards to force the skirts of the two adjoining peg boards into pressure abutment against each other. Where such expandability or modification of the size or shape of the peg board is not important, a simpler modified peg board 36 is shown in FIGS. 48-49 that does not include recesses along the skirt for using the connectors 32. However, the rest of the construction is identical or substantially similar to the peg board 10 previously described.

Using the kit 18 to create a wide variety of woven items as well as embellishments is simple and convenient. Tapestry weaving is the most common and easiest to do. For most weavings, there are just two directions for the yarns. The first yarn is used to create the warp. These are the vertical strands of yarn that form the base on which the horizontal yarns, called the weft, are woven.

Figure 52:
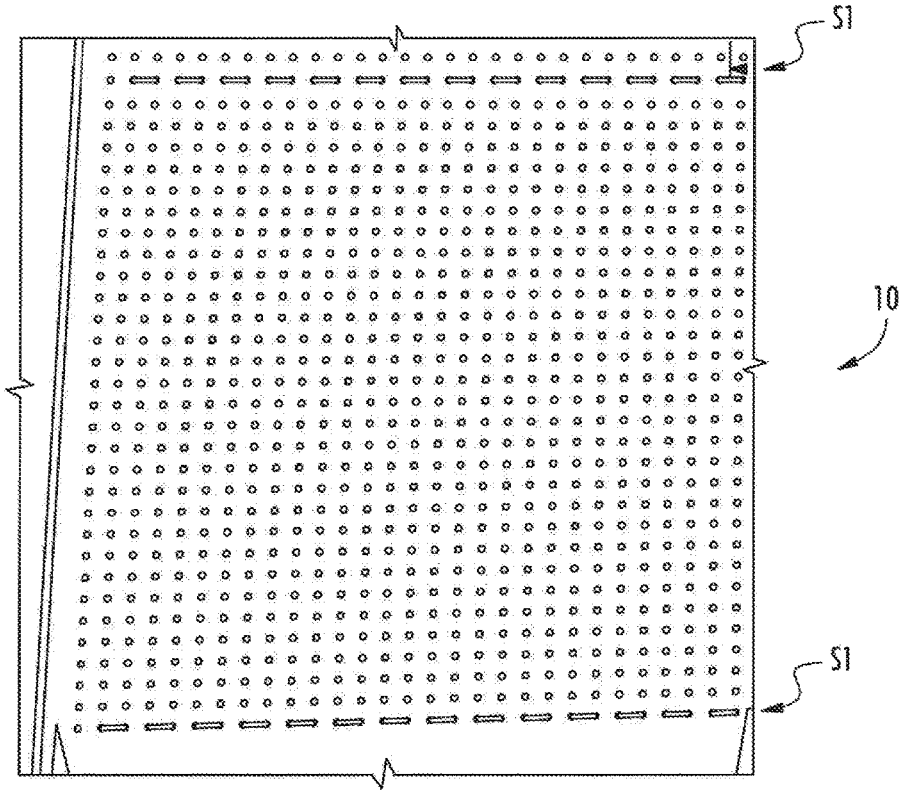
FIG. 52 is a top plan view of a peg board in accordance with the present invention prepared for tapestry weaving.
Figure 53:
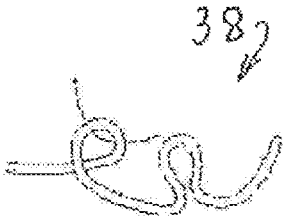
FIGS. 53-55 show the steps for creating a slip knot around a corner peg mounted on the board shown in FIG. 52.
Figure 54:
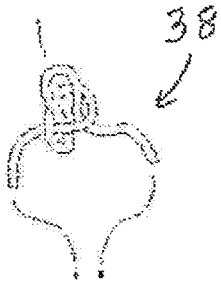
Figure 55:
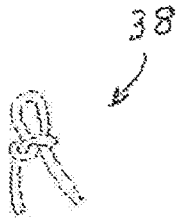
Figure 56:
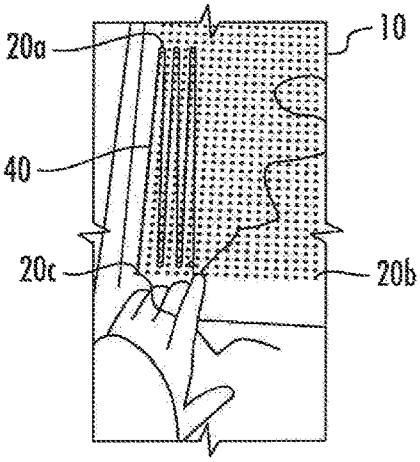
FIGS. 56 and 57 illustrate different stages of warping the loom.
Figure 57:
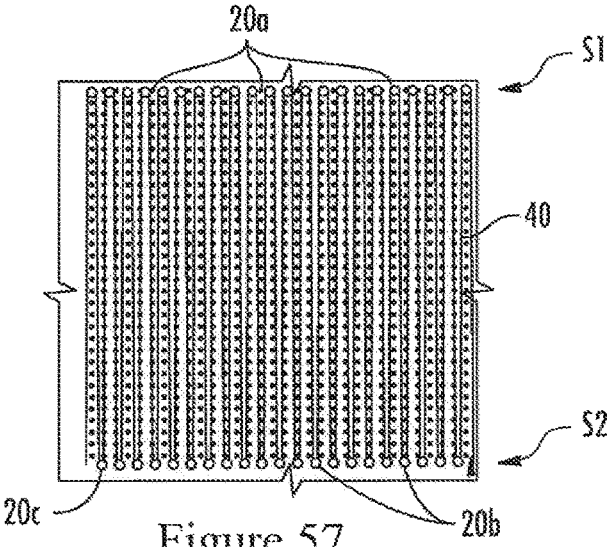
Figure 58:
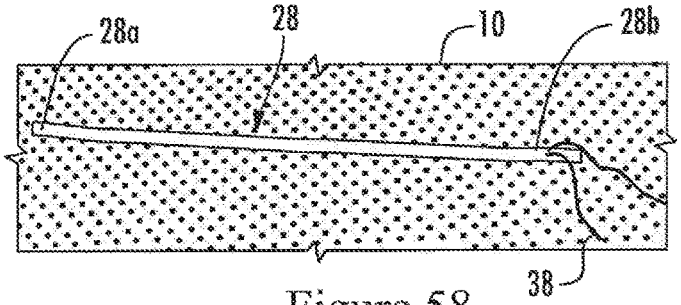
FIG. 58 illustrates the shuttle of FIGS. 25-27 prepared for weaving the weft.
Figure 59:
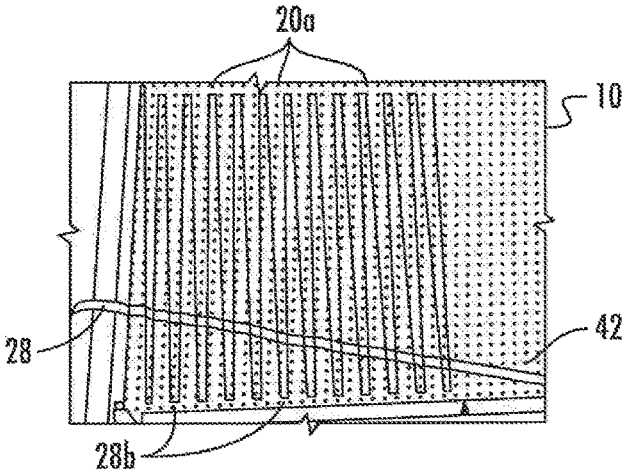
FIGS. 59 and 60 illustrate different stages of weaving a first row of the weft.
Figure 60:
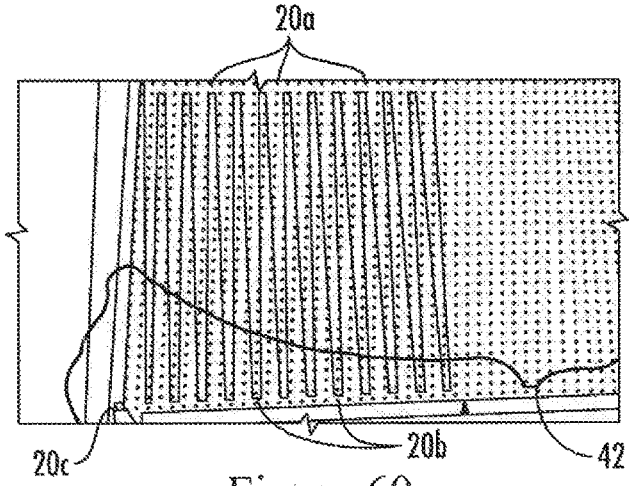
Figure 61:
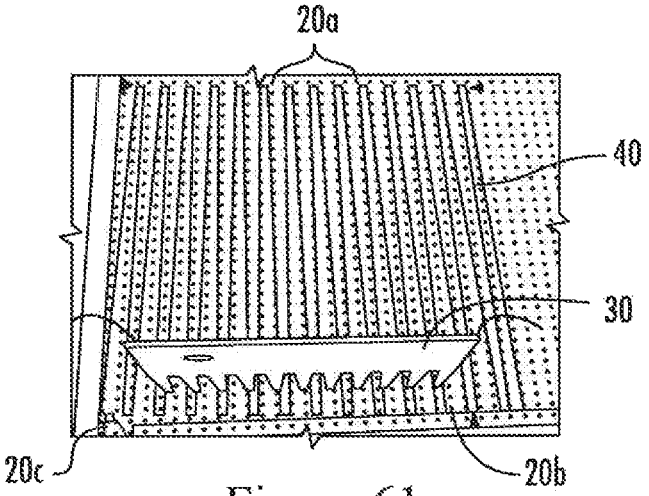
FIG. 61 illustrates a comb of the type shown in FIGS. 39-41 combining the first row of the weft.
Figure 62:
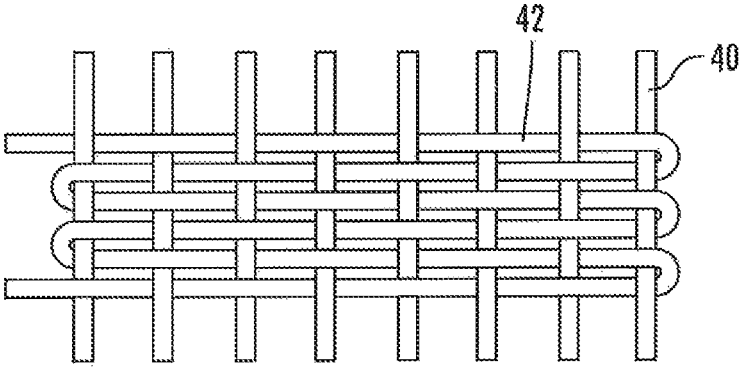
FIG. 62 is a diagrammatic view of the weave when subsequent rows of the weft are woven in relation to the warp.
Figure 63:
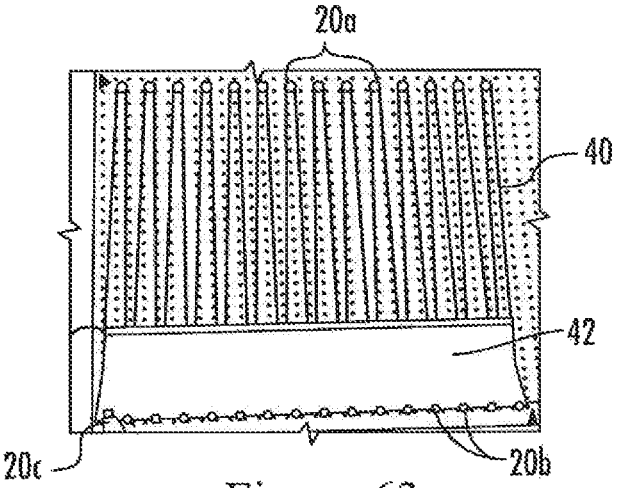
FIG. 63 is similar to FIG. 61 after multiple rows of the well have been woven in accordance with the procedure shown in FIG. 62.

Initially, the size of the project must be determined and the pegs must be set up. Referring to FIG. 52 the peg board 10 is shown with two opposing parallel sets S1, S2 of short pegs 20. The pegs are inserted evenly spaced in two rows, one row for the top of the piece and one row for the bottom of the piece. For lighter weight yarns, insert pegs in every hole. For heavier weight yarns, insert pegs in every other hole as shown.

Referring to FIGS. 53 to 57 weaving can be carried out as follows:

Step 1: Warping the Loom

1. Leaving a 6 in. (15 cm) tail, a slip knot is formed at the end of the yarn 38 and it is placed around the lower left peg. The slip knot is tightened around the peg.

2. The yarn is carried up to the top row of pegs and wrapped it over the upper left peg.
3. The yarn is brought back down to the bottom row of pegs and wrapped under the next peg. Holding a finger on top of each peg as shown when wrapping the next peg prevents slippage.
4. A light and even tension is maintained while the yarn continues to be wrapped from bottom to top until all pegs, except the last peg, have been wrapped.
5. When the last peg is reached, the yarn is held taught and cut leaving a 6 in. (15 cm) tail. The tail is tied around the last peg.

Step 2: Weaving the Weft

Referring to FIGS. 58 to 63 a piece of yarn 3 to 4 yards long is cut. One end of the yarn is inserted into the eye of the shuttle and pulled into the slit to secure the yarn. A yard or so can be pulled through the shuttle to start 1. First Row:

Begin near the lower right edge of the loom and, working from right to left, slide the shuttle 23 over the first warp thread, then under the next warp thread and over the next warp thread, under the next, etc. all the way across.

The shuttle 23 and the yarn are pulled all the way through the warp threads until only a 6 in. (15 cm) tail of yarn remains on the right side. The yarn is pulled through at an angle to ensure that there is enough yarn to settle around the warp threads when the weft is pressed into place.

The comb is used to press the new weft thread down into place so the weft yarn is even and straight across.

2. Second Row:

Working from left to right, the shuttle passed under the first warp thread, then alternately over the next warp thread and under the next warp thread all the way across. The yarns should be woven so that the yarns that were under on a previous row are over on a subsequent row and those that were over on the previous row are now under.

To ensure a straight edge, a finger should be placed on the yarn at the beginning of the row to hold it in place and the weaver is pulled all the way through taking care to leave a little slack in the yarn to prevent the sides from pulling in. Even though the yarn may look too slack at the edges, this will disappear when the woven work is removed from the board.

The comb is used to press the new weft thread down into place as was done on the previous row.

Weaving continues back and forth, holding the yarn down at the edge for the beginning of each row, until one runs short of yarn or wants to change color.

Step 3: Adding a New Length of Yarn

Figure 64:
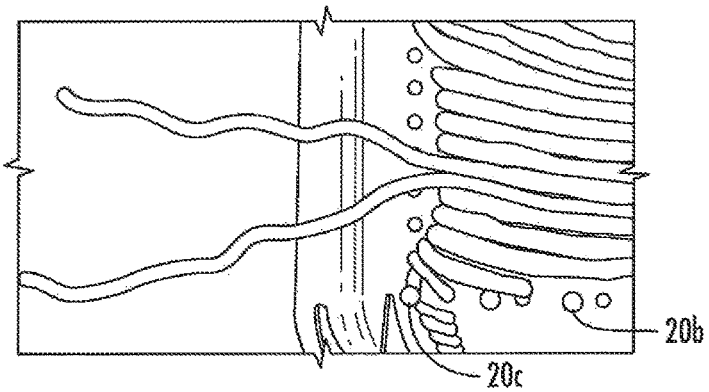
FIG. 64 illustrates the procedure for adding more yarn when weaving the weft.
Figure 65:
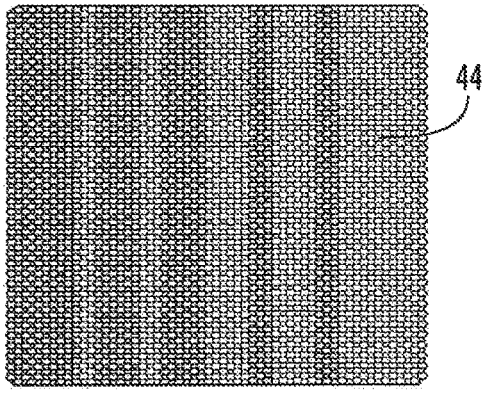
FIG. 65 illustrates a completed woven work after it has been removed from the peg board.

Referring to FIG. 64, a new length of yarn needs to be added when almost all of the current weft yarn has been used or to change to a different color or texture of yarn. The easiest way to do this is to work with the old yarn, weaving complete rows, until there is not enough yarn remaining to weave another row. The old yarn is dropped at the end of the row (to be woven in later). A 6 in. (15 cm) tail is left, and one can begin weaving the next row with the new yarn.

Step 4: Finishing the Weave

As one gets closer to the upper pegs, one may want to change from the shuttle 23 to one of the tapestry or needle weavers 24, 26. This will make it easier to weave in those last couple of rows.

1. Remove the knots from the beginning and ending pegs and untie the knots.
2. Tie each yarn tail around the neighboring warp thread.
3. When the top of the work has been reached, the wrapped yarns are gently lifted up from around the pegs.
4. Any loose yarn ends are woven on the back of the work and the ends trimmed.

Different Techniques for Using Loom

Technique 1: Weaving with Color and Texture

Figure 66:
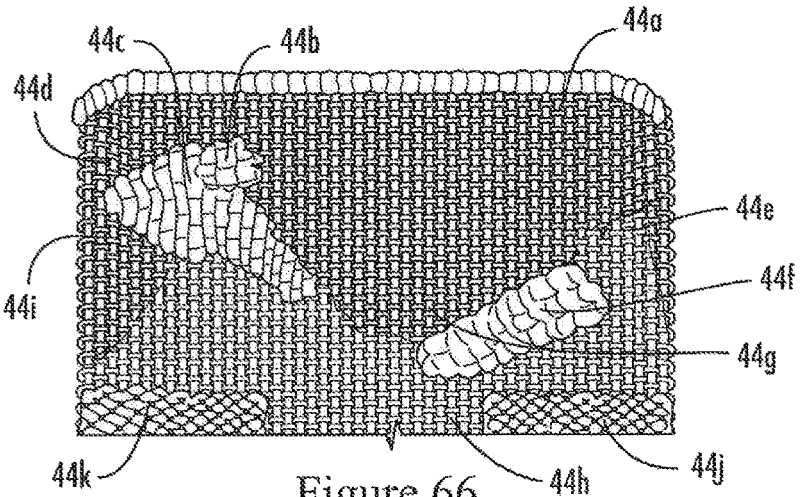
FIG. 66 illustrates a technique of weaving with color and texture using the loom of the invention.
Figure 67:
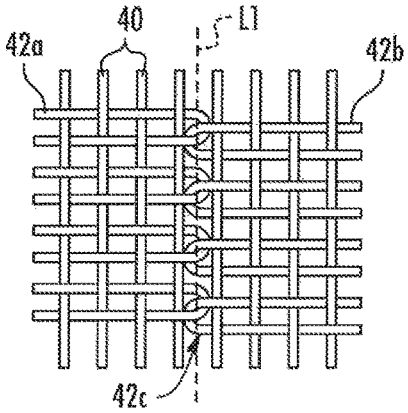
FIGS. 67-72 illustrate different techniques for weaving sections of different colors by interlocking, dovetailing and slitting the woven yarns.
Figure 68:
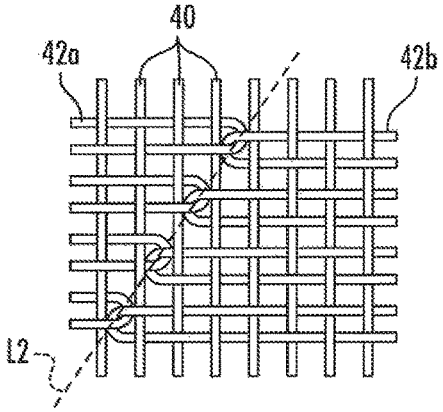
Figure 69:
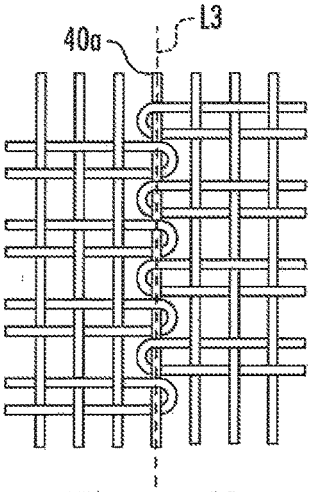
Figure 70:
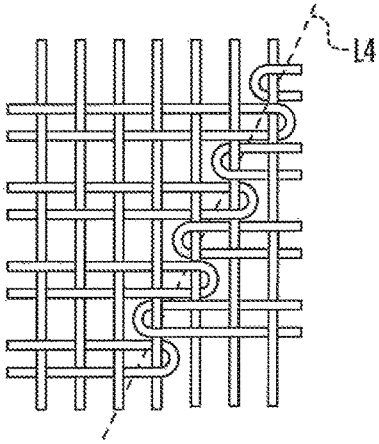

Tapestry weaving is known for its colorful and textural sections. See FIG. 66.

Creating these is easy to do after one has mastered the basic weaving technique described above.

Weaving Sections of Color

To produce sections of color, pictures or designs in a tapestry, one can weave over small sections of well threads rather than across the entire board. Instead of weaving each row all the way across one can turn part way across and work back in the opposite direction to produce sections of color or texture. Patterns placed behind the warp yarns, can aid in making pictorial tapestries.

Referring to FIGS. 67 to 74, sections can be woven one at a time or several sections can be worked at the same time. The ends where two sections meet can be managed in different ways.

Figure 71:
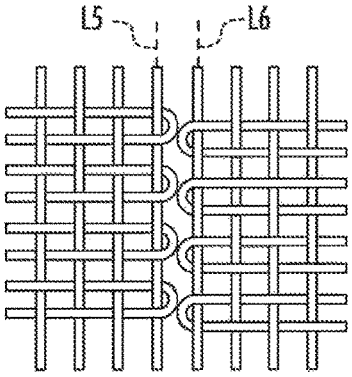
Figure 72:
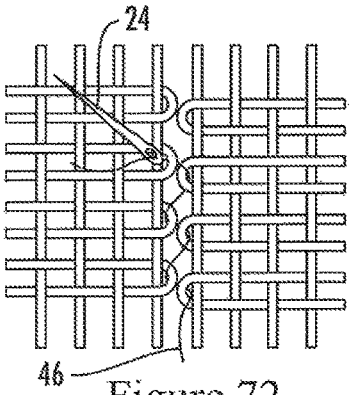

1. interlocking: This technique, shown in FIGS. 67 and 68 can be used when two meeting sections are woven at the same time. Weave one row of each section, weaving the right section from right to left and the left section from left to right so that the well threads meet at the center between the two sections. Twist the two weft threads around each other, then weave back in the opposite direction. Continue to twist the weft threads around each other until one or both sections are complete.
2. Dovetailed: This method of joining two sections of a tapestry, shown in FIGS. 69 and 70 occurs when alternating colors are wrapped around the same warp yarn.
3. Slits: When two sections meet a small slit forms as shown in FIGS. 71 and 72. A slit does not need to be closed if it is only a few rows long or is to be used as a buttonhole. If the weave is to be more than a few rows, the slit may be sewn and closed once the piece has been completed. A strong sewing thread can be used that is about the same color as one of the sections being joined.

Weaving Patterns

Figure 73:
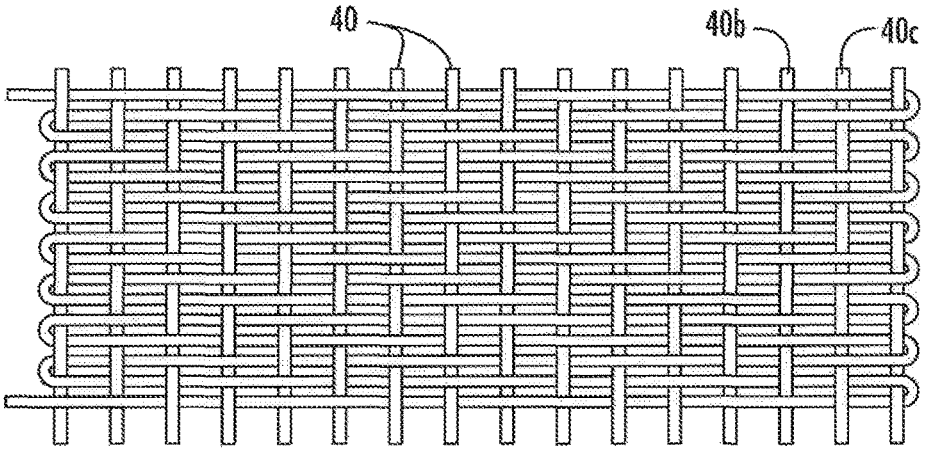
FIG. 73 is a diagrammatic representation for producing a twill weave using the present invention.
Figure 74:
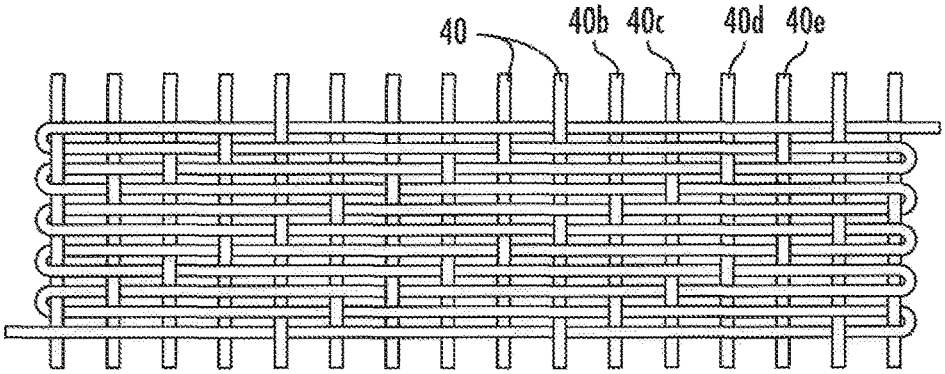
FIG. 74 is similar to FIG. 73 but illustrating the technique for satin weaving.

Referring to FIGS. 73 and 74 well yarns can be woven over and under more than one warp yarn at a time. When different numbers of warp yarns are woven over and under a weaving pattern is created. Some popular weaving patterns include: Twill Weave and Satin Weave.

Twill Weave: Weft yarns are woven over and under two or more warp yarns.

Satin Weave: Weft yarns are alternately woven over four or more warp yarns and a single warp yarn.

There are many different weaving patterns one can do on this loom. One can find additional patterns at www.lion-brand.com.

Technique 2: Shaped Weaving

The loom allows pegs to be placed in a variety of arrangements. The top and bottom rows of pegs can be arranged in curves or on a slant. Pegs can even be placed on all sides of the piece to make triangles, squares, circles, octagons, etc.

The weft can be woven as for tapestry weaving except for two important differences:

1. One turns and weaves back in the opposite direction each time one reaches the edge of the piece. This is similar to weaving in sections of color.
2. As an option, the weft yarn can be wrapped around the side pegs before turning to weave back in the opposite direction. Wrapping the weft yarn around a peg helps keep the side edges from pulling in and creates a small loop on the edge. These loops can simply be decorative or can be used when putting pieces together to make larger pieces. However, not every weft yarn needs to be wrapped around a side peg. Depending on the weight of the yarn and the space between side pegs, only every other or every third weft yarn may be wrapped around a side peg.

Step 1: Inserting the Pegs

Figure 75:
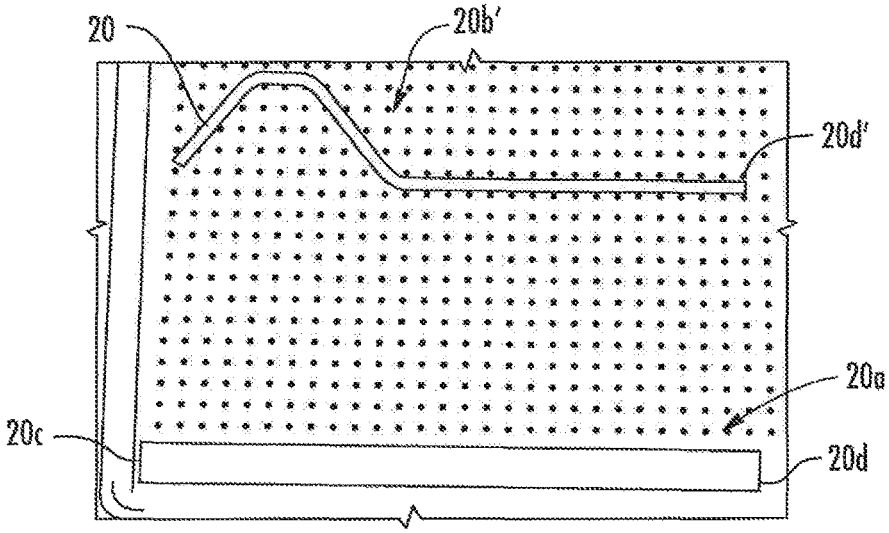
FIGS. 75-79 illustrate the technique of shaped weaving using the loom of the present invention.

Referring to FIG. 75 insert pegs in loom to create desired shape. When first beginning shaped weaving, one may wish to follow detailed pattern instructions for peg placement, warping, and weaving.

Step 2: Warping the Loom

Figure 76:
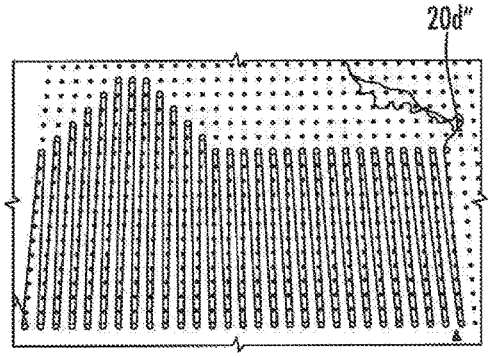

Wrap the warp yarn from bottom to top around the pegs, until all top and bottom pegs have been wrapped, as shown in FIG. 76.

Step 3: Weaving the Weft

Figure 77:
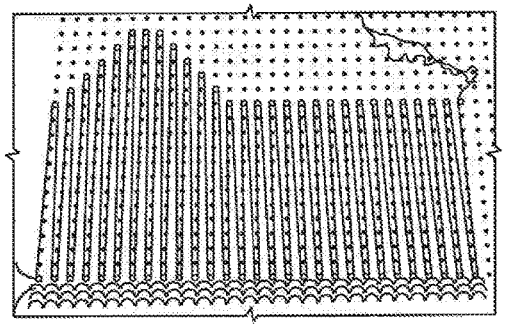

Weave the weft yarn over and under the warp yarns, back and forth in rows, turning each time that the end of a row is reached. Add new lengths of well yarn as needed. If there are pegs at the end of a row they can skipped or can be wrapped around. If the pegs at ends of rows are wrapped, this will leave small loops on those edges. The loops can be decorative or can be used to sew edges together. This is illustrated in FIG. 77.

Step 4: Finishing the Weave

Figure 78:
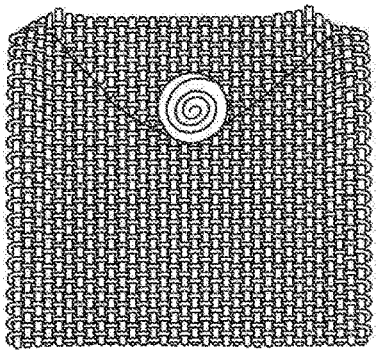

Remove the piece from the loom and weave in ends on the back of the piece, as suggested in FIG. 78.

All Sides Weaving

Figure 79:
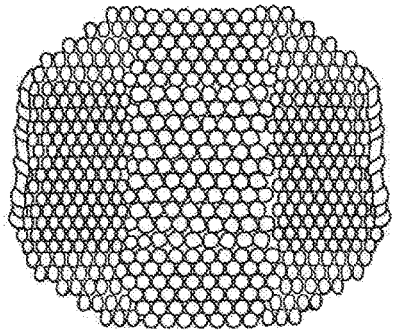

There are some warping and weaving methods that are unique to all sides weaving. See FIG. 79.

Figure 80:
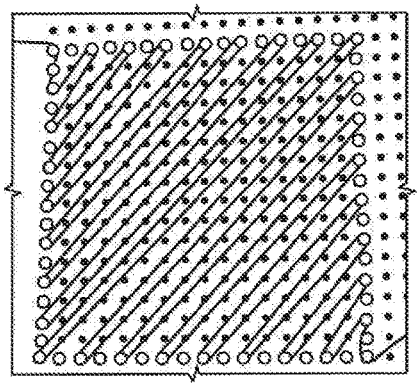
FIGS. 80-87 illustrate additional weaving techniques that are made possible with the hand loom of the invention.
Figure 81:
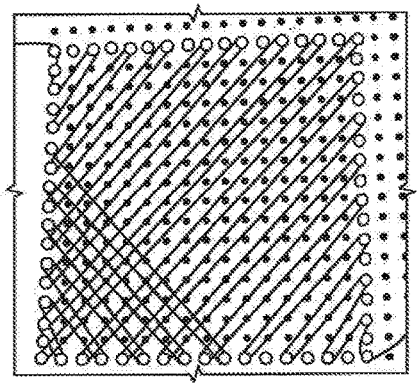
Figure 82:
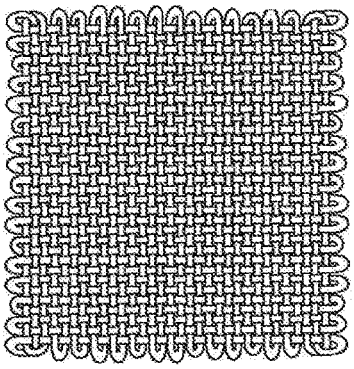
Figure 83:
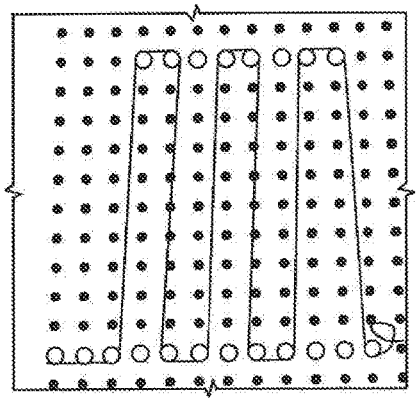
Figure 84:
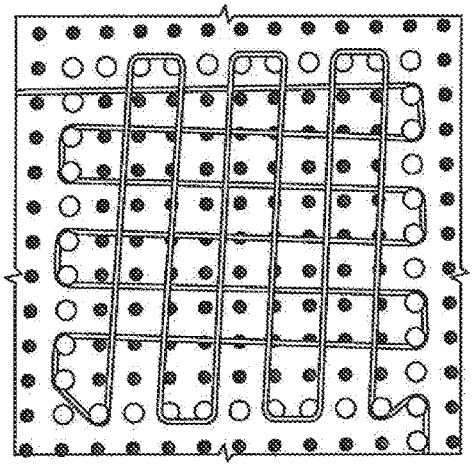
Figure 85:
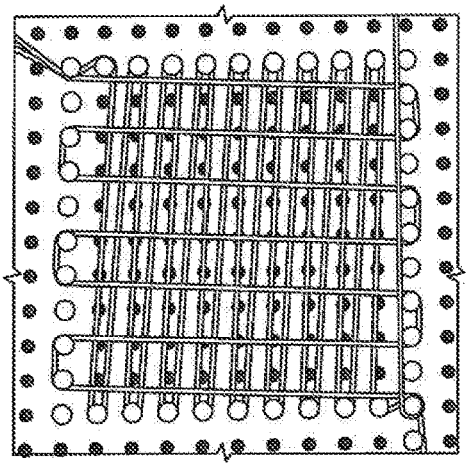
Figure 86:
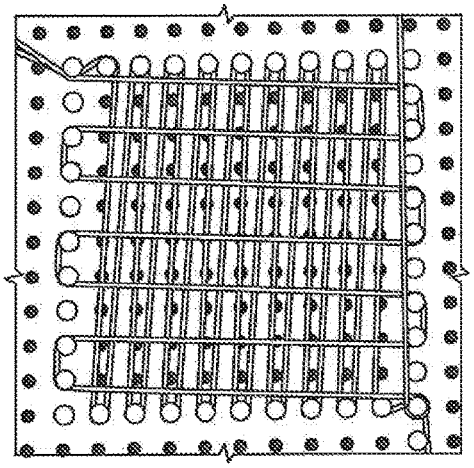
Figure 87:
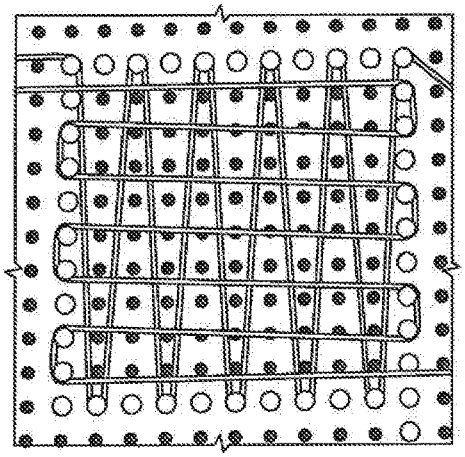

Diagonal Weaving:

The weft can be woven beginning in a corner of the piece and woven diagonally across the warps, weaving longer and longer rows until you reach the center diagonal. Then weaving shorter and shorter rows until one reaches the opposite corner. Another technique for weaving diagonally can be found at www.lionbrand.com/diyweaver. This is shown in FIGS. 80, 81.

Wrap First Warp

Refer to FIGS. 83 to 87.

1. Insert pegs in a square or rectangle. Do not place pegs in the corners and make sure that the number of pegs on each side of the square is evenly divisible by 3.
2. Leaving a 6 in. (15 cm) tail, make a slip knot and place it on the lower right peg.
3. Bring the yarn up to the top right peg and wrap it over the first two top right pegs.
4. Bring the yarn back down to the lower pegs. Skip the next unwrapped peg and wrap the yarn under the next two lower pegs.
5. Bring the yarn back up to the top pegs. Skip the next unwrapped peg and wrap the yarn over the next two top pegs.
6. Maintaining loose but even tension, continue wrapping the yarn from bottom to top until you reach the lower left peg.

Wrap First Weft

1. Wrap the yarn under the lower left peg and around the first peg on the left side.
2. Bring the yarn across to the first peg on the right side. Wrap the yarn around the first two pegs on the right side.
3. Bring the yarn back across to the left side pegs. Skip the next unwrapped peg and wrap the yarn over the next two left pegs.
4. Bring the yarn across to the right side. Skip the next unwrapped peg and wrap the yarn over the next two right pegs.
5. Maintaining light but even tension, continue wrapping the yarn from left to right until the top left side peg is reached.

Wrap Second Warp

1. Wrap the yarn around the top left side peg and over the first top peg.
2. Bring the yarn down to the lower left peg. Wrap the yarn around the first two lower left pegs.
3. Bring the yarn back up to the top pegs. Skip the next unwrapped peg and wrap the yarn over the next two top pegs.
4. Bring the yarn back down to the lower pegs. Skip the next unwrapped peg and wrap the yarn under the next two lower pegs.
5. Maintaining light but even tension, continue wrapping the yarn from top to bottom until the top right peg is reached.

Weave the Second Weft

Before beginning weaving, estimate the amount of yarn that will be needed by carefully wrapping the yarn around the outside of the pegs 4½ times and cut the yarn. Unwrap the yarn and thread the end onto the needle weaver.

1. Wrap the yarn over the upper right peg. The first row of the second weft is woven between the top pegs and the first weft (horizontal) strand.
2. Insert the needle between the first top two pegs on the right side, then under the first warp yarn, over the next warp yarn, under the next warp yarn and so on all the way across. Draw the needle and yarn all the way through, bringing the needle out just above the top peg of the left side.
3. Skip the next two pegs on the left side and insert the needle over the first warp yarn, under the next warp yarn, over the next warp yarn and so on all the way across. Skipping one peg on the right side, draw needle between the next two right pegs.
4. Skip the next two pegs on the right side and insert the needle under the first warp yarn, over the next warp yarn, under the next warp yarn and so on all the way across. Skipping one peg on the left side, draw the needle between the next two left pegs.
5. Continue weaving the yarn back and forth, weaving the last row between the bottom pegs and the last strand of the first weft.

Remove piece from loom and weave in ends on back side. The loops on the sides make a nice decorative edge and can also be used if sewing pieces together. As in tapestry crochet, different weaving patterns can be used when making pin weaving pieces.

Combining Pieces Together

Pieces can be sewn or crocheted together to create larger projects such as scarves, bags, and blankets.

Technique 3: Shag or Rya

Figure 88:
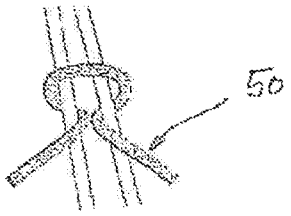
FIG. 88 illustrates a technique of creating a shag or rya using the loom of the invention.

Refer to FIG. 88 this technique produces a pile or short fringe on the surface of your weaving. It can be compared to latch hook, but the cut yarn pieces are knotted around warp yarns instead of a canvas. One can use this technique as part of a tapestry design or for an entire weaving.

1. To prepare, cut lengths of yarn a couple inches longer than twice the desired length of the pile.
2. Using a different yarn, weave a few rows of plain weave.
3. Pick up a length of the cut yarn, and following the diagram, wrap the cut yarn around the first pair of warp yarns and draw the ends up through the center.
4. Holding the ends of the cut yarn, slide the knot down against the previous row of weaving.
5. Continue across the row, repeating Steps 3 and 4.
6. Work four to eight rows of rya.
7. Weave four to six rows of plain weave to lock the rya knots in place. Note that very little of these plain weave rows will be seen as they will be hidden by the rya.
8. Continue to alternate rows of rya knots and plain weave.

When there are an odd number of weft threads, skip the 2nd to last thread and tie the last rya knot over the last two threads. Do not leave the first or last thread of a row of knots empty.

Technique 4: Embellishments

Flowers

Figure 89:
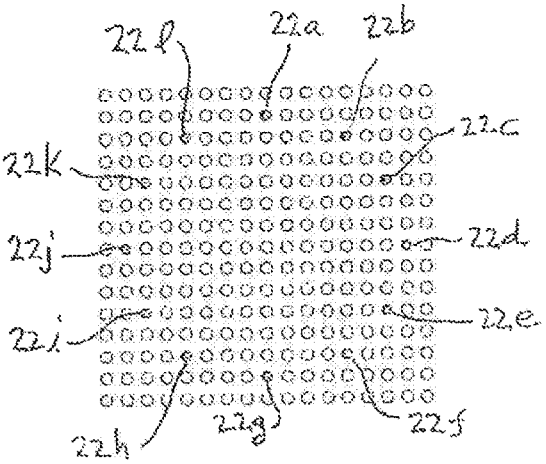
FIGS. 89-94 illustrate a technique of creating embellishments, and specifically flowers, using the hand loom of the invention.
Figure 90:
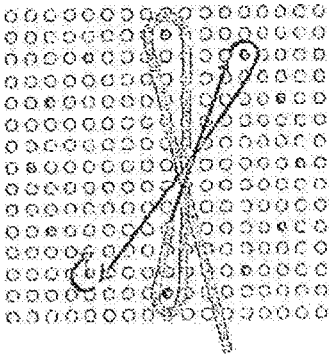
Figure 91:
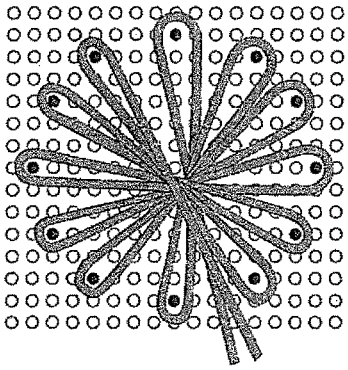

Referring to FIGS. 89 to 91 flowers can be formed with the loom by using the long pegs 22 arranged on the peg board 10 as a function of the desired embellishment 1. Insert pegs in a circle.
2. Leaving a 2 in. (5 cm) tail, make a slip knot and place it on one of the pegs.
3. Take the yarn straight across and wrap it around the opposite peg.
4. Take the yarn back and wrap it around the beginning peg.
5. Take the yarn back to the other side and wrap it around the next peg to the right.
6. Take the yarn to the other side and wrap it around the next peg to the left.
7. Continue to take the yarn back and forth, wrapping it around the next peg on each side, working counter-clockwise until all pegs have been wrapped.
8. Tie the yarn loosely around the beginning, peg and cut the yarn, leaving a 2 in. (5 cm) tail.

Figure 92:
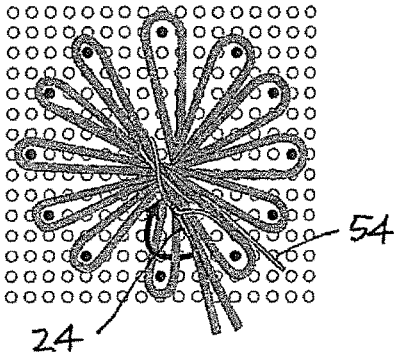
Figure 93:
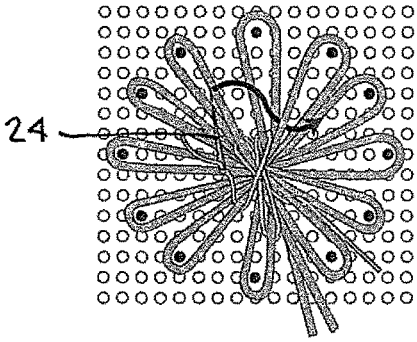

Refer to FIGS. 92 to 93 to create a flower with a Solid Center:

1. Thread a 20 in. (51 cm) length of yarn onto a tapestry needle.
2. Leaving a 6 in. (15 cm) tail, insert the needle from back to front through one of the flower loops then back down through the loop directly opposite.
3. Working clockwise, continue inserting the needle from back to front up through one loop and down through the opposite loop until yarn has been passed through the center of all of the loops and the end of the yarn is on the back side.
4. Tie the ends of the length together tightly.
5. Weave tails into the back of flower.

Figure 94:
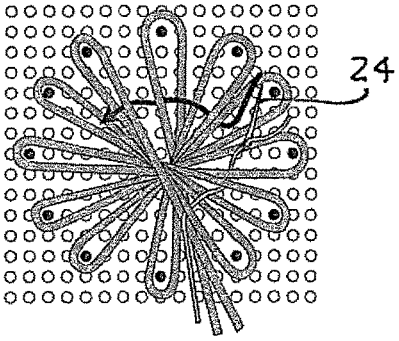

Refer to FIG. 94 a flower with an Outline Center can be created by:

1. Threading a 30 in. (76 cm) length of yarn onto a tapestry needle.
2. Leaving a 6 in. (15 cm) tail, insert the needle from back to front through one of the flower loops then back down through the next loop to the right.
3. Working counter-clockwise, continue inserting the needle from back to front up through one loop and down through the next loop to the right until yarn has been passed through the center of all of the loops and the end of the yarn is on the back side.
4. Fingers can be used to press the yarn towards the center of the flower as the ends of the yarn are pulled to tighten.
5. Tie the ends of the length together tightly.
6. Cut another length of yarn and, working clockwise, sew another round of stitches in the same manner. Work as many rounds of outline center stitches as desired. Use different colors for each round if desired.

Figure 94A:
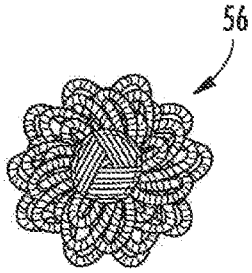
FIG. 94*a* illustrates a finished flower in accordance with the technique shown in FIGS. 89-94.

Remove flower from loom by untying the beginning and ending knots and lifting all loops from the pegs. Weave tails into back of flower. See FIG. 94*a*.

For a fuller flower, wrap the yarn all the way around the circle several times.

The pegs do not have to be in a perfect circle to make lovely flowers, a square-ish circle will work fine.

Pompoms

Figure 95:
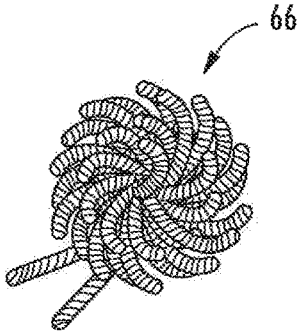
FIGS. 95 and 95*a* illustrates finished pom poms that can be created on the hand loom of the invention.
Figure 95A:
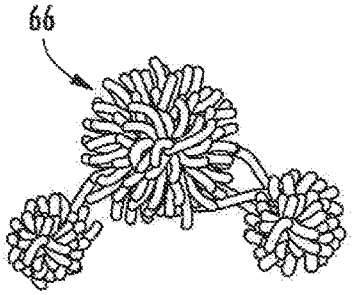
Figure 96:
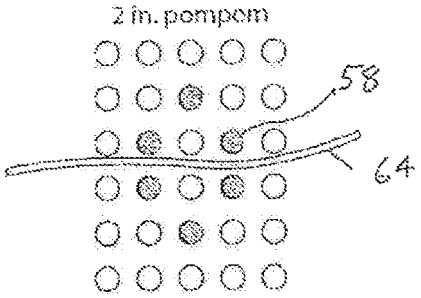
FIGS. 96-98 illustrate the technique for forming differently sized pom poms using the hand loom.
Figure 97:
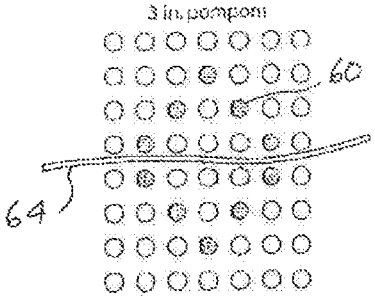
Figure 98:
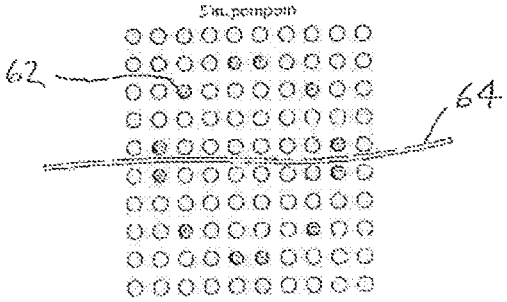

Pompoms can be created. To do so, referring to FIGS. 95-98:

1. Insert two long pegs as far apart as one and a half the desired diameter of the pompom.
2. Cut a piece of yarn the about 12 in. (5 cm) long.
3. Lay the piece of yarn across the loom half way between the pegs. This piece of yarn will be used to tie the center of the pompom.
4. Wrap yarn around and around the pegs. The more wraps, the fluffier the pompom. Press the wraps downwards as you wrap.
5. Tie the center of the wraps together tightly.
6. Slide the pompom off the pegs and cut the wrapped yarn at both ends.
7. Trim and fluff the pompom. See FIG. 95*a*.

Tassels

Figure 99:
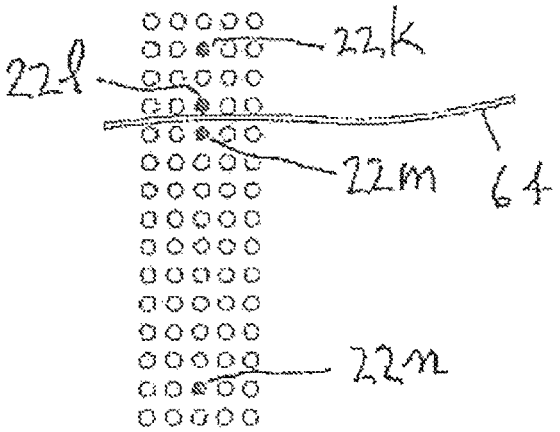
FIG. 99 illustrates a technique that can be used to form a tassel using the hand loom of the invention.
Figure 100:
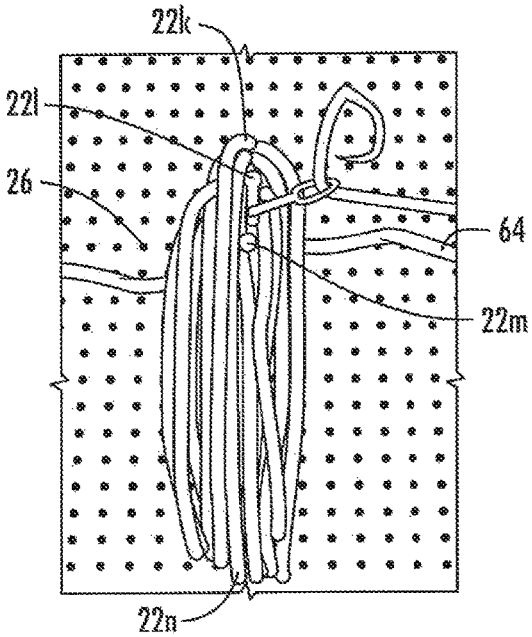
FIG. 100 illustrates the procedure for creating the tassel in accordance with the procedure shown in FIG. 99.

The loom can be used to make tassels as shown in FIGS. 99-100.

Figure 100A:
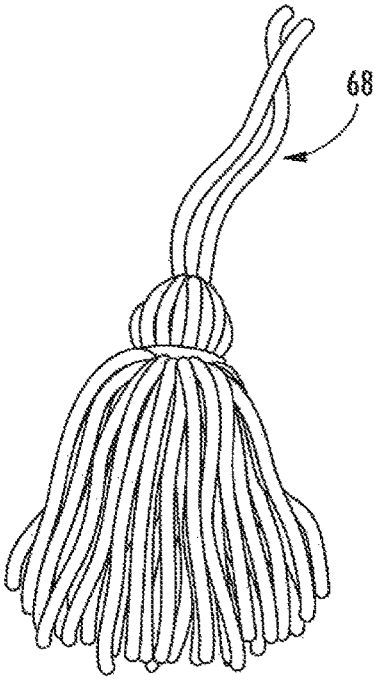
FIG. 100*a* illustrates a finished tassel made in accordance with the procedures suggested in FIG. 99-100.
Figure 101:
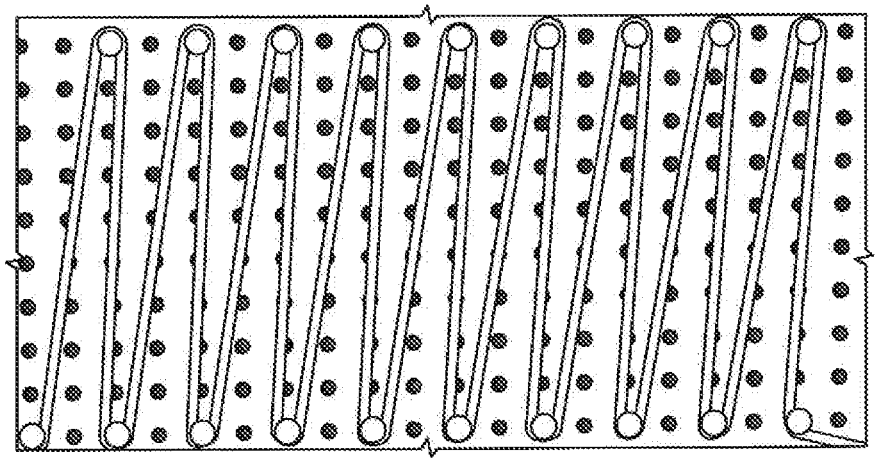
FIGS. 101-104 illustrate a procedure for creating a fringe using the loom of the invention.
Figure 102:
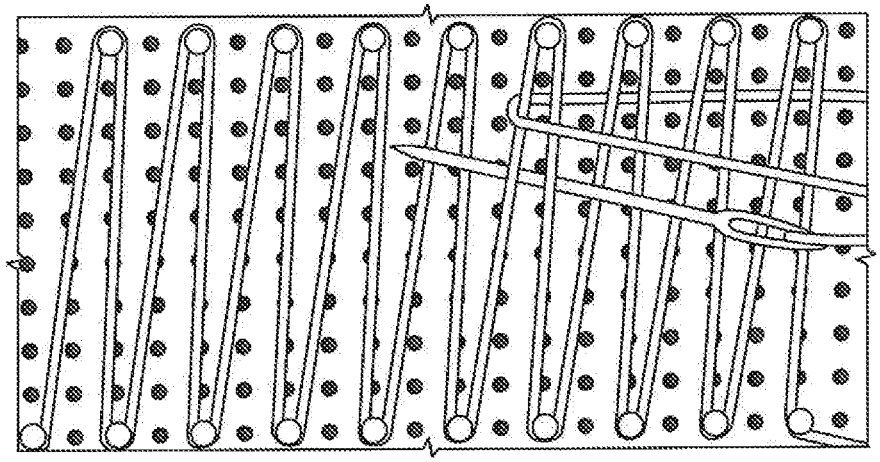
Figure 103:
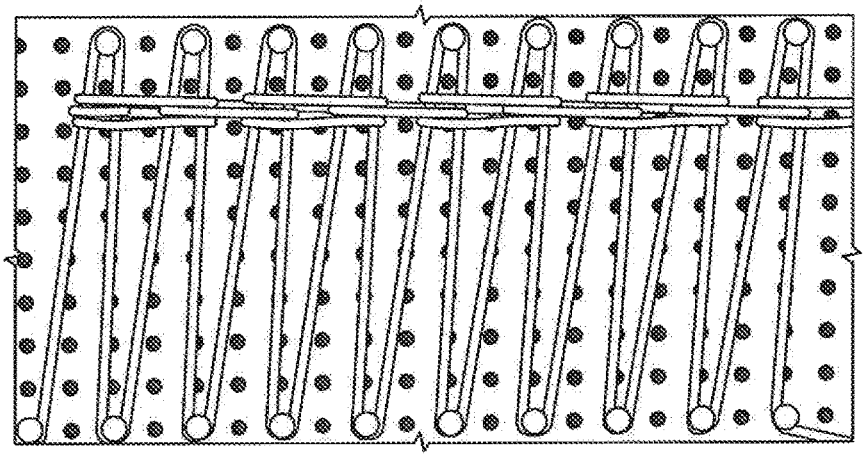
Figure 104:
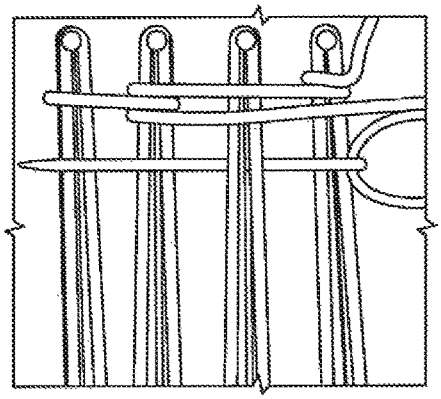
Figure 105:
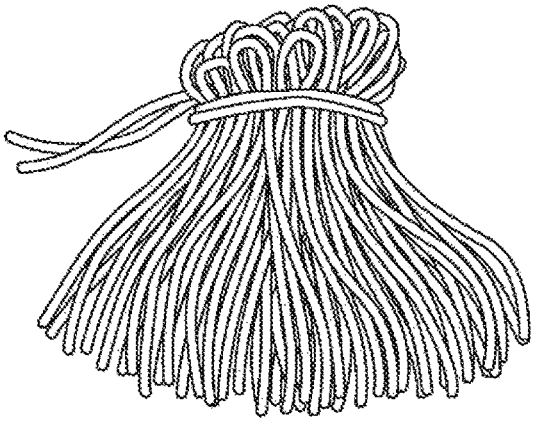
FIG. 105 illustrates a finished fringe made in accordance with the procedures shown in FIGS. 101-104.

1. Insert Long Pegs. Note: Peg placement shown is for a 5 in. (12.5 cm) tassel, but one can make any length tassel.
2. Cut two 24 in. (61 em) lengths of yarn and place the first as shown for tying neck of tassel. Leave 6" (15 cm) of yarn to one side of the pegs and the remainder to the other side. Place the second length of yarn aside.
3. Make a slip knot and loop it over the lower peg.
4. Make the desired number of wraps and cut the yarn. In the example shown 25 wraps for a #5 weight yarn were made. For thinner yarn, make more wraps. For thicker yarn, make fewer wraps.
5. Thread the remaining 24 in. (61 cm) length of yarn onto the needle weaver. Insert the needle through the loops under the top peg for the hanging cord. Bring the yarn through and leave it.
6. Tie the neck-tying yarn tightly around the wraps.
7. Slip the tassel off the pegs.
8. Tie the ends of the hanging cord together at the top of the tassel.
9. Using the longer end of yarn, wrap the neck of the tassel a few times with the neck-tying yarn and tie to shorter end. Thread ends of the neck-tying yarn to the center of the tassel.
10. Cut the loops. A finished tassel is shown in FIG. 100*a*.

Fringe

Fringes can also be made using the loom. Referring to FIGS. 101-104, a length of fringe can be made by repeating the steps below. If an even longer length of fringe is desired, one can remove the finished section of fringe and move it over to the right or left just off the board.

The instructions below are for a cut fringe. For instructions on making a bullion fringe, additional information can be found at www.lionbrandyarn.com. One can easily sew or crochet this fringe onto a purchased throw or one that has been made.

1. Insert pegs evenly spaced in two rows, one top row and one lower row at the length where you want the fringe to end.
2. Attach the yarn with a slip knot to the lower left peg.
3. Carry the yarn up to the top row of pegs and wrap it over the upper left peg.
4. Bring the yarn back down to the bottom row of pegs and wrap it under the next peg.
5. Continue wrapping the yarn from bottom to top until all pegs have been wrapped. Then wrap in the same manner from right to left. Continue wrapping back and forth until the desired thickness of fringe has been achieved.
6. Thread the small tapestry needle with about 2 yards of yarn. Use a yarn that is the same weight or lighter than the wrapped yarn. Use a color that coordinates, as it will show.
7. Tie the yarn around the first group of fringes.
8. Using a backstitch, wrap all fringes across the board, but do not cut yarn.
9. Working back in the opposite direction, work another row of back stitches, immediately below the first row.
10. Slide the wraps up close to the top pegs. Then lift the fringe off the pegs.
11. Cut the lower edge of the wraps. A finished fringe is shown in FIG. 100*a*.

In view of the foregoing, the kit 18, including a peg board 10 or 36, provides a flexible or versatile kit for creating a multitude of woven products as well as embellishments. The kit is simple, light weight and easy to use thereby avoiding the need for a user to have and change between various devices to accomplish the same functions.

The foregoing is considered as illustrative only of the principles of the invention. Further, since numerous modifications and changes will readily occur to those skilled in the art, it is not desired to limit the invention to the exact construction, dimensions and operation shown and described, and accordingly, all suitable modifications and equivalents may be resorted to, falling within the scope of the invention.

What is claimed:

1. A universal hand loom kit comprises a peg board provided with a rectangular array of holes forming a plurality of spaced rows and a plurality of orthogonal spaced columns;

a plurality of long pegs each configured at one end to be releasably inserted into one of the holes in the peg board, each long peg having an exposed length when mounted on the peg board within the range of 2"-4" or approximately 50 mm-102 mm;

a plurality of short pegs each configured at the one end to be releasably inserted into one of the holes in the peg board, each short peg having an exposed length when mounted on the peg board less than the length of the long pegs;

a shuttle, a needle weaver, a short tapestry needle and a comb, the kit having the versatility to quickly convert from a device for creating two dimensional woven tapestry-type products of different sizes, shapes, colors and configurations to a device that is used to make three dimensional objects or embellishments selected from the group comprising flowers, pompoms, tassels and fringes.

2. A universal hand loom kit as defined in claim 1, wherein the ratio of the number of standard or short pegs to the number of embellishment or long pegs is approximately 10:1.

3. A universal hand loom kit as defined in claim 1, wherein said peg board has a predetermined thickness and an enlarged thickness boss surrounding each hole to enhance the stability of pegs inserted into said holes.

4. A universal hand loom kit as defined in claim 1, wherein said peg board is provided with a skirt at least partially extending about a periphery of said peg board.

5. A universal hand loom kit as defined in claim 4, wherein said skirt extends about the entire periphery of said peg board.

6. A universal hand loom kit as defined in claim 4, further comprising connecting means associated with said skirt for securing at least two peg boards to each other to effectively enlarge the weaving surface area.

7. A universal hand loom kit as defined in claim 6, wherein said connecting means comprises first connecting portions on said skirt and second connecting portions for engagement with first connecting portions on two peg boards to be secured or connected to each other.

8. A universal hand loom kit as defined in claim 7, wherein said first connecting portions comprise receptacles and said second connecting portions comprise joiners dimensioned to be received within two juxtaposed receptacles.

9. A universal hand loom kit as defined in claim 1, wherein each of said pegs has a mounting end or foot configured to provide a snap fit within a hole into which it is inserted.

10. A universal hand loom kit as defined in claim 1, with a bulbous enlargement or protuberance dimensioned to be received within a hole in press-fit relationship.

11. A universal hand loom kit as defined in claim 1, wherein said exposed length of said long pegs is approximately 66 m and said short pegs have an exposed length of approximately 11 mm.

12. A universal hand loom kit as defined in claim 1, wherein approximately 15 long pegs and approximately 150 short pegs are provided.

13. A method of weaving a substantially two-dimensional design by using a hand loom kit that comprises a peg board provided with a rectangular array of holes forming a plurality of spaced rows and a plurality of orthogonal spaced columns;

a plurality of long pegs each configured at one end to be releasably inserted into one of the holes in the peg board, each long peg having an exposed length when mounted on the peg board within the range of 2"-4" or approximately 50 mm-102 mm;

a plurality of short pegs each configured at the one end to be releasably inserted into one of the holes in the peg board, each short peg having an exposed length when mounted on the peg board less than the length of the long pegs; and a shuttle, a needle weaver, a short tapestry needle and a comb, the kit having the versatility to quickly convert from a device for creating two dimensional woven tapestry-type products of different sizes, shapes, colors and configurations to a device that is used to make three dimensional objects or embellishments selected from the group comprising flowers, pompoms, tassels and fringes, comprising the steps of arranging short pegs on said peg board to corresponding to a desired design of an item to be woven;

warping the loom; and weaving the weft.

14. A universal hand loom kit as defined in claim 13, wherein at least a section of the item is in color.

15. A method of weaving a substantially three-dimensional design or embellishment by using a loom kit that comprises a peg board provided with a rectangular array of holes forming a plurality of spaced rows and a plurality of orthogonal spaced columns;

a plurality of long pegs each configured at one end to be releasably inserted into one of the holes in the peg board, each long peg having an exposed length when mounted on the peg board within the range of 2"-4" or approximately 50 mm-102 mm;

a plurality of short pegs each configured at the one end to be releasably inserted into one of the holes in the peg board, each short peg having an exposed length when mounted on the peg board less than the length of the long pegs; and a shuttle, a needle weaver, a short tapestry needle and a comb, the kit having the versatility to quickly convert from a device for creating two dimensional woven tapestry-type products of different sizes, shapes, colors and configurations to a device that is used to make three dimensional objects or embellishments selected from the group comprising flowers, pompoms, tassels and fringes, comprising the steps of arranging long pegs corresponding to a desired three dimensional design of an item to be woven; and at least partially wrapping yarn about said long pegs, the heights of said three-dimensional designs being equal up to the exposed lengths of said long pegs.

16. A universal hand loom kit as defined in claim 15, wherein said embellishment is a flower.

17. A universal hand loom kit as defined in claim 15, wherein said embellishment is a tassel.

18. A universal hand loom kit as defined in claim 15, wherein said embellishment is a fringe.

19. A universal hand loom kit as defined in claim 15, wherein said embellishment is a pom pom.

20. An expansion kit for a universal hand loom kit comprises a base peg board provided with a rectangular array of holes forming a plurality of spaced rows and a plurality of orthogonal spaced columns;

a plurality of long pegs each configured at one end to be releasably inserted into one of the holes in the peg board, each long peg having an exposed length when mounted on the peg board within the range of 2"-4" or approximately 50 mm-102 mm;

a plurality of short pegs each configured at the one end to be releasably inserted into one of the holes in the peg board, each short peg having an exposed length when mounted on the peg board less than the length of the long pegs;

a shuttle, a needle weaver, a short tapestry needle and a comb, the kit having the versatility to quickly convert from a device for creating two dimensional woven tapestry-type products of different sizes, shapes, colors and configurations to a device that is used to make three dimensional objects or embellishments selected from the group comprising flowers, pompoms, tassels and fringes, said expansion kit comprising an additional peg board;

additional pegs; and joiners or connectors for selectively attaching said base and additional peg boards to each to create a larger or extended weaving surface or area.

21. A universal hand loom kit as defined in claim 20, wherein with the expansion kit the combined number of standard or short pegs to the number of embellishment or long pegs is in a ratio of at least a 5:1.

* * * * *